US012509970B2

(12) United States Patent
Roberts et al.

(10) Patent No.: US 12,509,970 B2
(45) Date of Patent: Dec. 30, 2025

(54) DETONATOR ASSEMBLY FOR A PERFORATING GUN ASSEMBLY

(71) Applicant: Halliburton Energy Services, Inc., Houston, TX (US)

(72) Inventors: Courtney Ann Thain Roberts, Alvarado, TX (US); Kevin Cook, Alvarado, TX (US); Cynthia Anne Kane, Alvarado, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 68 days.

(21) Appl. No.: 18/500,751

(22) Filed: Nov. 2, 2023

(65) Prior Publication Data

US 2024/0210151 A1 Jun. 27, 2024

Related U.S. Application Data

(60) Provisional application No. 63/434,421, filed on Dec. 21, 2022.

(51) Int. Cl.

| | |
|---|---|
| ***E21B 43/1185*** | (2006.01) |
| ***E21B 17/02*** | (2006.01) |
| ***F42B 3/10*** | (2006.01) |
| ***F42B 3/103*** | (2006.01) |
| ***F42B 3/198*** | (2006.01) |

(52) U.S. Cl.

CPC ..... *E21B 43/1185* (2013.01); *E21B 17/028* (2013.01); *F42B 3/103* (2013.01); *F42B 3/198* (2013.01)

(58) Field of Classification Search

CPC .. F42B 3/10; F42B 3/103; F42B 3/198; E21B 17/028; E21B 43/1185; E21B 43/119

USPC ..... 102/206; 89/1.15, 1.151

See application file for complete search history.

(56) References Cited

U.S. PATENT DOCUMENTS

| | | | |
|---|---|---|---|
| 4,539,909 | A | 9/1985 | Day et al. |
| 4,703,986 | A | 11/1987 | McCormick |
| 4,718,345 | A | 1/1988 | Yunan |
| 4,778,404 | A | 10/1988 | Pass |
| 5,201,598 | A | 4/1993 | Tehan |
| 5,775,419 | A | 7/1998 | Gramlich |

(Continued)

FOREIGN PATENT DOCUMENTS

| | | | | |
|---|---|---|---|---|
| DE | 102021108869 | A1 * | 11/2021 | ..... E21B 43/1185 |
| WO | WO-2015134719 | A1 * | 9/2015 | ..... B01D 63/046 |

(Continued)

OTHER PUBLICATIONS

Machine Translation of DE 102021108869 A1 (Year: 2021).*

(Continued)

*Primary Examiner* — James S Bergin

(74) *Attorney, Agent, or Firm* — John W. Wustenberg; C. Tumey Law Group, PLLC

(57) ABSTRACT

In general, in one aspect, embodiments relate to a detonator assembly that includes a detonator housing that includes a detonating cord receptacle and a detonator receptacle, a detonator seated within the detonator receptacle, a detonating cord seated within the detonating cord receptacle side-by-side the detonator, and a grounding clip that extends lengthwise along a substantial portion of the detonator housing, where the grounding clip extends beyond an axial end of the detonator housing.

10 Claims, 20 Drawing Sheets

(56) References Cited

U.S. PATENT DOCUMENTS

| | | | | |
|---|---|---|---|---|
| 6,059,595 | A | 5/2000 | Lacrouts-Cazenave | |
| 6,112,813 | A | 9/2000 | Head | |
| 6,783,405 | B1 | 8/2004 | Yen | |
| 7,121,340 | B2 | 10/2006 | Grove et al. | |
| 7,197,985 | B2 | 4/2007 | Markel et al. | |
| 8,286,697 | B2 | 10/2012 | Evans et al. | |
| 8,347,963 | B2 | 1/2013 | Johnson et al. | |
| 8,555,764 | B2 | 10/2013 | Le et al. | |
| 8,939,802 | B2 | 1/2015 | Hara et al. | |
| 8,978,749 | B2 | 3/2015 | Rodgers et al. | |
| 9,523,265 | B2 | 12/2016 | Upchurch et al. | |
| 9,605,937 | B2 | 3/2017 | Eitschberger et al. | |
| 10,365,078 | B2 * | 7/2019 | Eitschberger | F42D 1/05 |
| 10,507,433 | B2 | 12/2019 | Eitschberger et al. | |
| 10,669,821 | B2 | 6/2020 | Knight et al. | |
| 11,078,761 | B2 | 8/2021 | Grove et al. | |
| 11,098,563 | B1 | 8/2021 | Ludwig | |
| 11,299,967 | B2 | 4/2022 | Bradley et al. | |
| 11,313,208 | B2 | 4/2022 | Hoelscher et al. | |
| 11,359,468 | B2 | 6/2022 | Roberts et al. | |
| 11,547,976 | B2 | 1/2023 | Ledwon et al. | |
| 11,560,778 | B2 | 1/2023 | Grove et al. | |
| 11,608,720 | B2 | 3/2023 | Preiss et al. | |
| 11,674,370 | B2 | 6/2023 | Shelton et al. | |
| 11,697,980 | B2 * | 7/2023 | Goyeneche | F42B 3/02 175/4.57 |
| 11,906,279 | B2 * | 2/2024 | Eitschberger | F42D 1/05 |
| 12,264,561 | B2 * | 4/2025 | Roberts | E21B 43/116 |
| 12,312,923 | B2 * | 5/2025 | Cook | E21B 43/119 |
| 12,320,203 | B2 * | 6/2025 | Roberts | E21B 17/028 |
| 12,352,551 | B2 | 7/2025 | Roberts et al. | |
| 2003/0047313 | A1 | 3/2003 | Wehunt, Jr. | |
| 2004/0216633 | A1 | 11/2004 | Kash | |
| 2004/0216866 | A1 | 11/2004 | Barlow et al. | |
| 2007/0084336 | A1 | 4/2007 | Neves | |
| 2007/0107589 | A1 | 5/2007 | Rospek et al. | |
| 2007/0119327 | A1 | 5/2007 | Myers, Jr. et al. | |
| 2010/0227514 | A1 | 9/2010 | Rikimaru et al. | |
| 2011/0042089 | A1 | 2/2011 | Chang et al. | |
| 2011/0127045 | A1 | 6/2011 | Spence et al. | |
| 2012/0181026 | A1 | 7/2012 | Le et al. | |
| 2014/0065351 | A1 | 3/2014 | Cordner et al. | |
| 2014/0260591 | A1 | 9/2014 | Rodgers et al. | |
| 2016/0376879 | A1 | 12/2016 | Goodman et al. | |
| 2017/0145798 | A1 | 5/2017 | Robey et al. | |
| 2017/0275974 | A1 | 9/2017 | Von Kaenel et al. | |
| 2018/0112500 | A1 | 4/2018 | Collins et al. | |
| 2018/0195372 | A1 | 7/2018 | Robey et al. | |
| 2020/0024935 | A1 | 1/2020 | Eitschberger et al. | |
| 2020/0048996 | A1 | 2/2020 | Anthony et al. | |
| 2020/0200516 | A1 | 6/2020 | Zemla et al. | |
| 2020/0248535 | A1 | 8/2020 | Goyeneche | |
| 2020/0256166 | A1 | 8/2020 | Knight et al. | |
| 2020/0392819 | A1 | 12/2020 | Robey et al. | |
| 2021/0172298 | A1 | 6/2021 | Knight et al. | |
| 2021/0222525 | A1 | 7/2021 | Dyess et al. | |
| 2021/0277752 | A1 | 9/2021 | Eitschberger | |
| 2021/0332678 | A1 | 10/2021 | Anthony et al. | |
| 2021/0396103 | A1 | 12/2021 | MacGillivray et al. | |
| 2022/0010660 | A1 | 1/2022 | Dyess et al. | |
| 2022/0018226 | A1 | 1/2022 | Wells et al. | |
| 2022/0018227 | A1 | 1/2022 | Kash et al. | |
| 2022/0099423 | A1 | 3/2022 | Sullivan et al. | |
| 2022/0127935 | A1 | 4/2022 | Grove et al. | |
| 2022/0145732 | A1 | 5/2022 | Anthony et al. | |
| 2022/0282600 | A1 | 9/2022 | Dyess et al. | |
| 2023/0069950 | A1 | 3/2023 | Badii et al. | |
| 2023/0184066 | A1 | 6/2023 | Hoelscher et al. | |
| 2025/0101839 | A1 | 3/2025 | Hoelscher | |

FOREIGN PATENT DOCUMENTS

| | | | |
|---|---|---|---|
| WO | 2016118179 | A1 | 7/2016 |
| WO | 2021198145 | A1 | 10/2021 |
| WO | 2022184731 | A1 | 9/2022 |

OTHER PUBLICATIONS

International Search Report and Written Opinion for International Patent Application No. PCT/US2023/083902 dated Apr. 18, 2024. PDF file. 10 pages.

Halliburton. Velocity™ Perforating System Plug and Play Guns for Pumpdown Operations. Halliburton, 2021. H012844WP Mar. 2021. PDF file. 8 pages.

Halliburton. Velocity™ Perforating System Improved Surface Efficiency and Downhole Reliability. Halliburton, 2017. H012737 Dec. 2017. PDF file. 1 page.

Halliburton. Velocity™ Aligned Gun System. Halliburton, 2023. H014094 Feb. 2023. PDF file. 2 pages.

Halliburton. Velocity™ Revolve Gun System. Halliburton, 2023. H014095 Feb. 2023. PDF file. 2 pages.

International Search Report and Written Opinion for International Patent Application No. PCT/US2023/080589 dated Mar. 19, 2024. PDF file. 10 pages.

International Search Report and Written Opinion for International Patent Application No. PCT/US2023/080587 dated Mar. 19, 2024. PDF file. 8 pages.

* cited by examiner

DETONATOR ASSEMBLY FOR A PERFORATING GUN ASSEMBLY

CROSS-REFERENCE TO RELATED APPLICATIONS

The present application is a nonprovisional patent application claiming priority to U.S. Provisional Patent Application No. 63/434,421 filed Dec. 21, 2022, the entirety of which is herein incorporated by reference.

BACKGROUND

Wells are often drilled to extract hydrocarbons, such as oil and gas. After drilling a wellbore that traverses a hydrocarbon-bearing formation, a casing string is installed to reinforce portions of the wellbore. A casing string comprises large diameter metal tubulars that are connected end-to-end, lowered into the wellbore, and cemented in place. The casing string increases the integrity of the wellbore and provides a structure for supporting other wellbore equipment such as production tubing used for producing fluids from one or production zones of the formation to surface. When a production zone is lined with casing, the casing is perforated to allow the formation fluids to enter the wellbore. These perforations are hydraulic openings that extend through the casing and into the surrounding formation.

Typically, perforations are created by lowering a perforating gun string downhole and detonating a series of explosive shaped charges adjacent to the production zone. For safety, perforating guns may be transported to a wellsite in a partially unassembled state to prevent accidental detonation. Once fully assembled at the wellsite, a perforating gun string may be lowered into the cased wellbore on an appropriate conveyance, such as a wireline. An explosive train is then initiated to detonate the shaped charges in a predetermined, serial fashion. The perforating gun string may then be retrieved to the surface. Common problems associated with these perforating gun strings may include, for example, occasional failure detonation after lowering of the perforating gun string to its target depth, poor ergonomics of assembly of the perforating guns, and high cost of manufacturing.

BRIEF DESCRIPTION OF THE DRAWINGS

These drawings illustrate certain aspects of some of the embodiments of the present disclosure and should not be used to limit or define the method.

FIG. 4G is a side view of a first perforating gun interfacing with a second perforating gun at a bulkhead, with portions of the gun bodies omitted for reference to show the charge tubes, detonator housing and grounding clip, and end alignment, in accordance with some examples of the present disclosure.

DETAILED DESCRIPTION

The disclosure is directed to a perforating gun assembly used during perforation of wellbore casings for hydrocarbon recovery, and more particularly, this disclosure relates to a detonator assembly that comprises a detonator housing, a detonator, and a detonating cord. The present disclosure may address reliability issues, provide designs that may reduce cost and may improve the ergonomics of the assembly during manufacture of, as well as on-site make-up of the perforating gun assembly. These features include, for example, interlocking joining features, a skeletonized body to aid in material reduction while not compromising integrity of the various parts, and various features to ensure reliable side-by-side detonation. Also disclosed is a detonator stop and detonating cord stop for allowing an assembler to locate the appropriate insertion depth of the detonation cord during assembly of the perforating gun(s). The features disclosed herein may, in some examples, address the various problems identified by this disclosure, namely, detonation failure, poor ergonomics of assembly, and high cost of manufacturing. The grounding clip may also mitigate to some degree risk of detonation failure by improving grounding of various components and preventing build-up of electric charge of one or more components, and side-by-side detonation of a detonating cord and a detonator may also ensure more reliable detonation.

Figure 1:
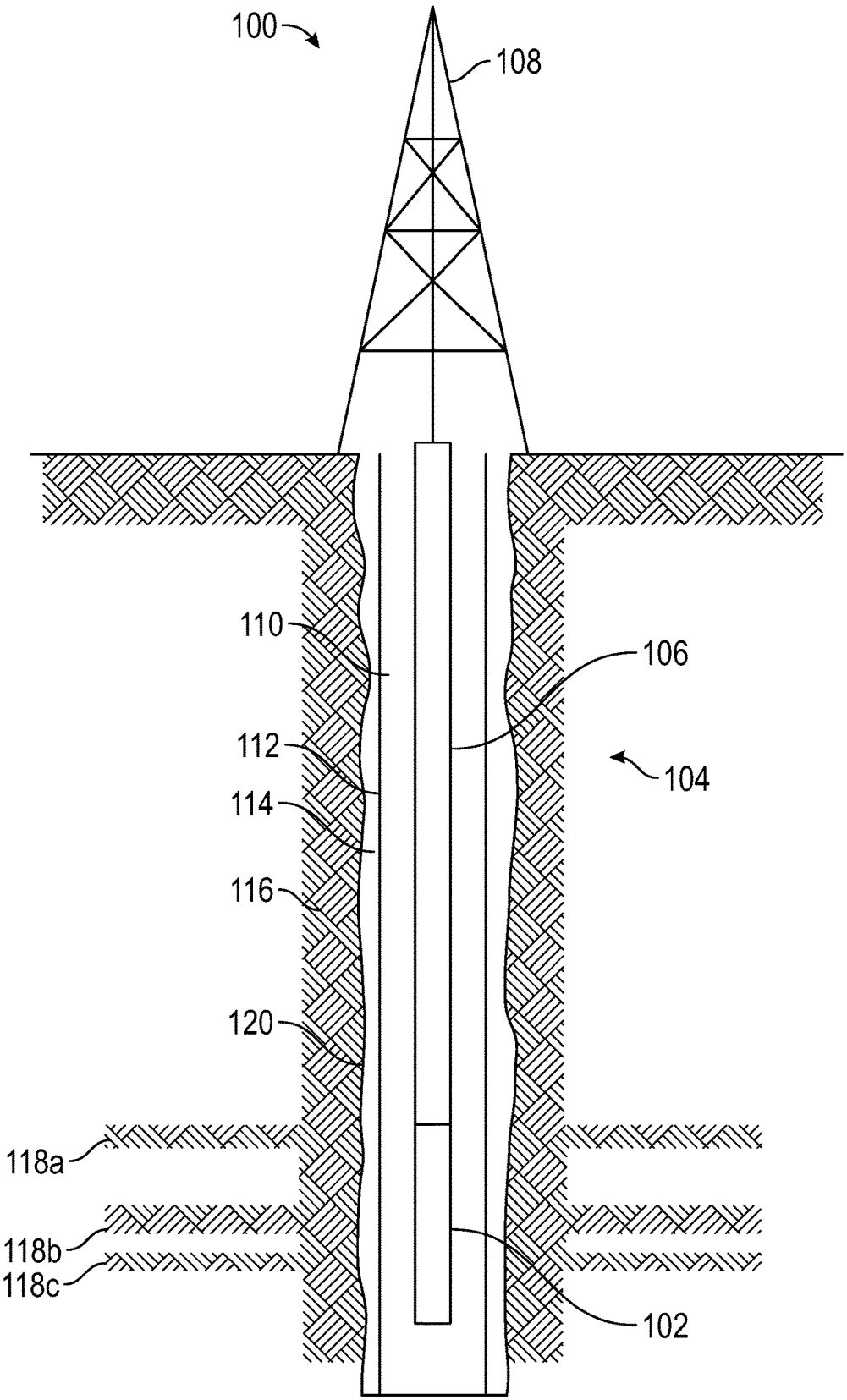
FIG. 1 is a system showing a perforating gun in a wellbore during a land-based operation, in accordance with some examples of the present disclosure.

FIG. 1 is a system 100 showing a perforating gun assembly 102 in a wellbore 110 during a land-based operation. The system 100 comprises a servicing rig 108 disposed on a terrestrial surface over a wellbore 110 extending into subterranean formation 116. Wellbore 110 may be vertical, deviated, horizontal, and/or curved at one or more regions of subterranean formation 116. Wellbore 110 may be cased, open hole, contain tubing, and may generally comprise a hole in the ground, i.e., "borehole", extending any appropriate distance into subterranean formation 116. In one or more examples, one or more regions of the wellbore 110 may be secured at least in part by cement 114.

Servicing rig 108 may be a drilling rig, completion rig, workover rig, or other mast structure supporting work string 104. In some examples, servicing rig 108 comprises a derrick and rig floor through which work string 104 extends downwards into wellbore 110. As will be shown in FIG. 2, a wellbore may be alternatively positioned in a sea-based environment, such as on a semi-submersible platform or rig, or otherwise disposed above a sea floor at an off-shore location.

As illustrated, work string 104 may comprise a conveyance 106 and a perforating gun assembly 102, i.e., "perforating gun string," "gun string," or "gun assembly," comprising one or more perforating guns. In addition, work string 104 may comprise other downhole tools, such as one or more packers, one or more completion components, e.g., screens and/or production valves, one or more sensing components and/or measuring equipment, i.e., downhole sensors, and other equipment not shown in FIG. 1. In operation, work string 104 is lowered into wellbore 110 and one or more explosive charges disposed within the one or more perforating guns are detonated to perforate casing 112 to facilitate fluid communication between one or more production zones ("pay zones") 118*a*, 118*b*, 118*c*, etc., and wellbore 110. As will be shown in later figures, e.g., FIGS. 3B and 3E, perforating gun assembly 102 may comprise a single or a plurality of perforating guns, which may be coupled together on a single gun string. While the present figures generally show a single, or a few perforating guns, it should be understood that perforating gun assembly 102 may comprise any suitable number of perforating guns. In one or more examples, the perforating gun assembly 102 may further comprise a firing head for initiating a detonation train to fire each of the perforating guns. In addition, the perforating gun assembly 102 may further comprise tandems, spacers, or other coupling structures for coupling together the perforating guns.

Figure 2:
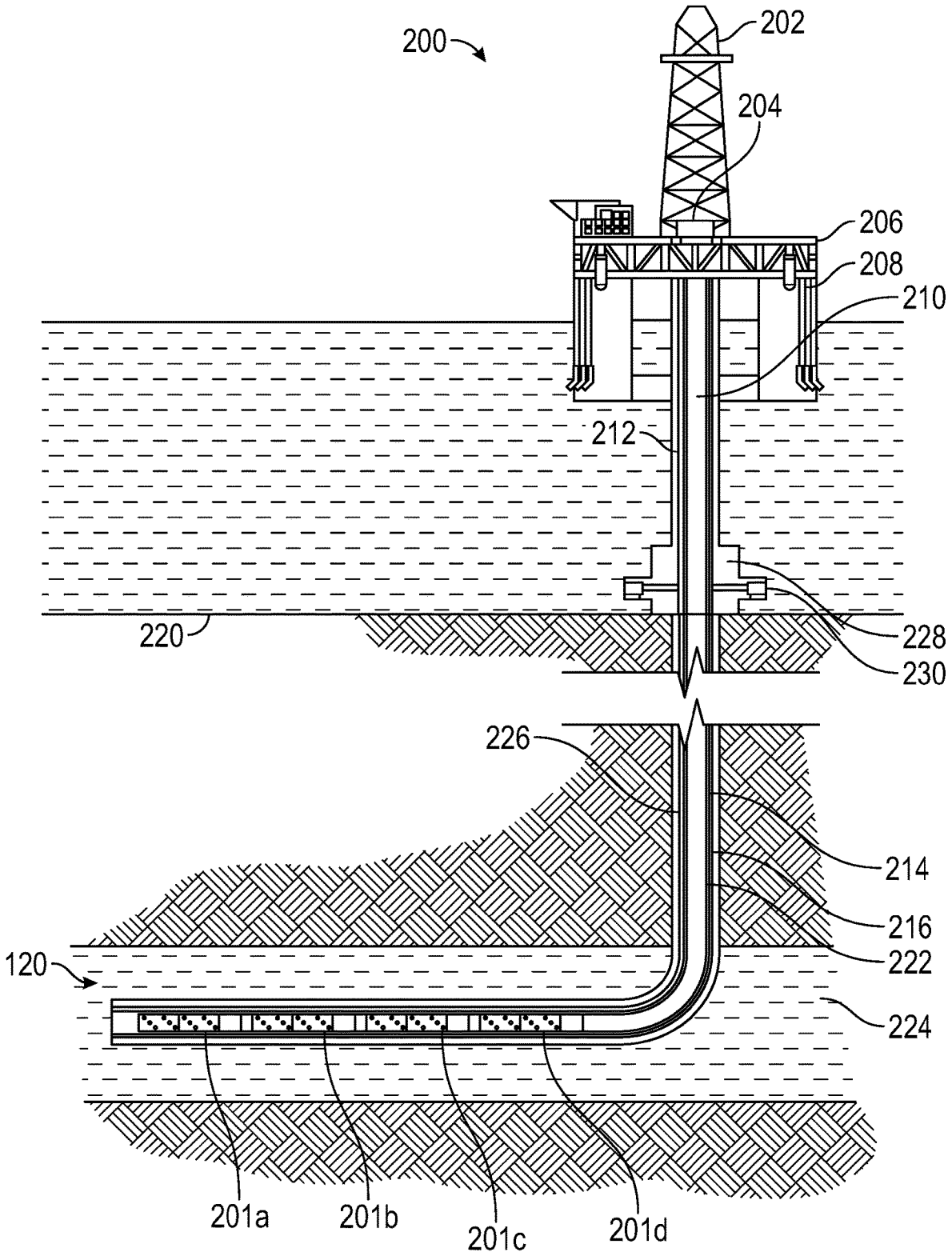
FIG. 2 is a system showing a perforating gun in a wellbore during a sea-based operation, in accordance with some examples of the present disclosure.

FIG. 2 is a system 200 showing one or more perforating guns 201*a*, 201*b*, 201*c*, and 201*d* in a wellbore 214 during a sea-based operation, in accordance with some examples of the present disclosure. As mentioned, the principles shown and described with respect to perforating during land-based operations are equally applicable to sea-based operations.

As illustrated, a wellbore 214 may extend into a subterranean formation 224 beneath a sea floor 220. A semi-submersible platform 206 is centered over a hydrocarbon-bearing formation 224 located beneath a sea floor 220. A subsea conduit 212 extends from deck 208 of platform 206 to wellhead installation 228 which may include one or more subsea blow-out preventers 230. Platform 206 has a hoisting apparatus 204 and a derrick 202 for raising and lowering tubular strings such as work string 210.

Figure 3A:
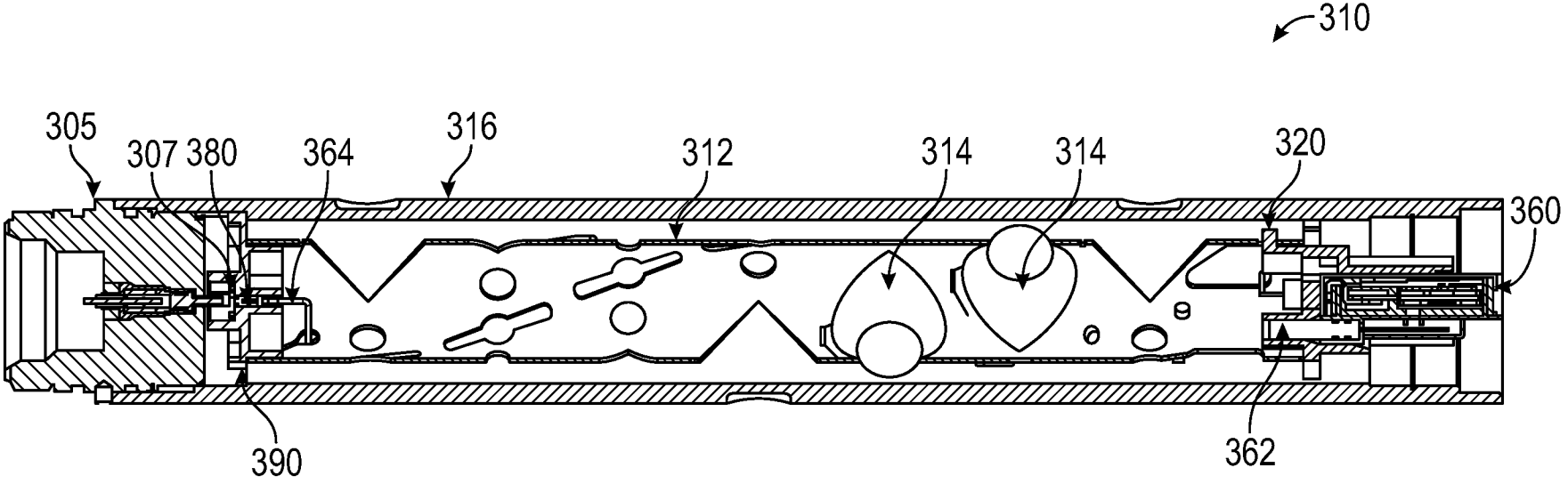
FIG. 3A is a single perforating gun in accordance with some examples of the present disclosure.
Figure 3B:
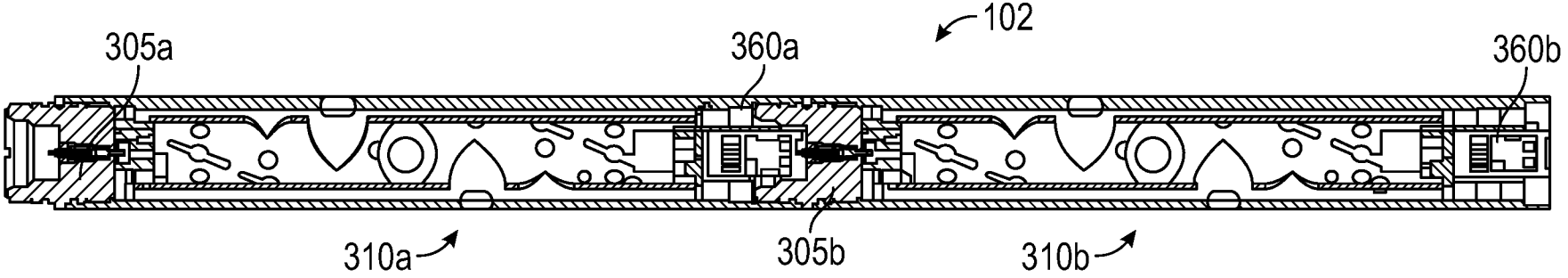
FIG. 3B shows a tubular string with two perforating guns coupled together, in accordance with some examples of the present disclosure.

A wellbore 214 extends through various earth strata including subterranean formation 224. Casing 226 is cemented within wellbore 214 by cement 216, as with FIG. 1. Work string 210 may be substantially identical to work string 104 (e.g., referring to FIG. 1), except that it is adapted for a subsea environment. In operation, work string 210 is similarly lowered through casing 226 until one or more perforating guns of work string 210 reach a desired depth. Thereafter, the explosive charges are detonated to perforate casing 226. In either of FIG. 1 or 2, detonation may occur in either a down-going (downhole) or an up-going (uphole) fashion. As shown, work string 210 comprises one or more perforating guns 201*a*, 201*b*, 201*c*, 201*d*, etc., which may be joined together during, for example, tubular make-up of the gun string. FIGS. 3A and 3B further show, with more detail, the perforating gun 310.

FIG. 3A is a side view of a single perforating gun 310 in accordance with some examples of the present disclosure. The perforating gun 310 may be one of a plurality of perforating guns connected end-to-end to achieve a perforating gun string (e.g., perforating gun assembly 102 on FIG. 1). The perforating gun 310 includes a gun body 316 that contains a bulkhead 305, an electrical contact 380, a gun body 316, a detonator housing 320 and detonator 360, and an end alignment 390. The gun body 316 is a generally tubular body, in this example, in which the other gun components are disposed. As illustrated, a plurality of perforating charges is secured to the charge tube 312 at different positions and firing orientations along the charge tube 312. The charge tube 312 has a generally continuous tubular construction in this example. However, all other suitable charge tube configurations are also within the scope of this disclosure, such as modular charge tubes formed by snapping together or otherwise interconnecting any number of charge tube segments that each hold one or more perforating charges within a perforating gun.

A detonator housing 320 according to this disclosure is coupled to the charge tube 312 at one end. The detonator housing 320 includes various features facilitating assembly including for securing a detonator, detonating cord, and other components, as further discussed below, and illustrated in subsequent figures. On the opposite end of the charge tube 312 from the detonator housing 320, the bulkhead 305 is secured to the charge tube 312. One purpose of the detonator housing 320 is to safely house the detonator such that it is protected from external influences (e.g., wellbore 110 of FIG. 1, build-up of static charge, etc.). The detonator housing 320 may comprise, in some examples, a skeletonized body to reduce the amount of volume occupied the detonator housing 320, which may slightly reduce the weight of a perforating gun, in some examples, without compromising the structural integrity of the piece.

The end alignment 390 is also coupled to the charge tube 312 at the other end opposite the detonator housing. The end alignment aligns the charge tube 312 within the gun body 316. As will be shown in subsequent figures, one or more (e.g., three, four, five, or more) radial protrusions may jut out from an inner tubular body of the end alignment 390. These radial protrusions serve to reduce the amount of material of, i.e., skeletonize, the end alignment 390 by not requiring that the whole outer circumference of the end alignment 390 be filled with the material. In addition, the end alignment 390 may comprise one or more alignment features which may also be disposed on one or more of the radial protrusions to facilitate appropriate alignment of the end alignment 390 within the perforating gun 310 when it interfaces with the charge tube 312 and/or bulkhead 305. Specifically, one or more matching slots (not shown) or other corresponding alignment feature (e.g., protrusion(s)) may be machined or designed within the gun body 316 or other component of the perforating gun 310 such that a mating notch 612 slides into place by an assembler when the end alignment 390 is installed within the gun body 316. This/these alignment feature(s) may also serve to circumferentially stabilize the end alignment and/or detonator assembly within the perforating gun 310 so as to prevent differential drift, i.e., rotation, of the end alignment 390 during or after assembly, which may ensure that the wires are not unnecessarily twisted or that the charge tube 312 is not improperly aligned, all the while reducing or preventing the need for additional fasteners. The end alignment 390 also comprises an electrical contact passthrough 307 to house one or more electrical connections.

The bulkhead 305 provides stability and structure to the perforating gun 310 as well as an interface to connect to a neighboring perforating gun. The bulkhead 305 generally comprises a body, an electrical feedthrough to house one or more electrical connections, and a receptacle to hold a contact pin.

The gun body 316 is the outer tubular body of the perforating gun 310 which houses all the main components of the perforating gun 310 including the charge tube 312, detonator housing 320, end alignment 390, and at least a portion of the bulkhead 305.

Use in the manner described herein may remove or reduce the need for external fasteners, which further increases productivity at the work site by making it easier for an assembler to assemble the perforating gun 310 and/or tubular gun string. For example, one or more sections of (e.g., the end alignment 390, bulkhead 305, detonator housing 320, charge tube 312, gun body 316, or any tubular components of) the perforating gun 310 may, in some examples, be free or essentially free of external fasteners.

As used herein, a "shipping assembly" comprises an at least partially assembled perforating gun which includes at least a gun body 316, a charge tube 312, and end alignment 390, and a bulkhead 305. A shipping assembly would generally not comprise more than a single bulkhead 305, as coupling of multiple perforating guns (e.g., 310*a*, 310*b* of FIG. 3B) would be achieved on-site during tubular make-up of the gun string (e.g., perforating gun assembly 102 of FIG. 3B). A shipping assembly may also comprise a detonator housing 320, however, installation of the detonator within the detonator housing 320 and perforating charges within the charge tube 312 of the perforating gun 310 would be generally performed on site to eliminate the risk of premature activation and accidental detonation of the perforating gun 310 prior to a perforating operation. However, in one or more examples, a shipping assembly may be loaded with detonating charges, or unloaded, as mentioned.

FIG. 3B shows a perforating gun assembly 102 with two perforating guns 310*a* and 310*b* coupled together, in accordance with some examples of the present disclosure. A first perforating gun 310*a* may be coupled to a second perforating gun 310*b* end-to-end, as illustrated. In the illustrated example, the first perforating gun 310*a* is uphole from the second perforating gun 310*b*.

In one or more examples, a detonation signal is transmitted during operation along the perforating gun assembly 102 in a down-going fashion. For example, the detonation signal may proceed from gun to gun, arriving first at the detonator 360*a* before passing through an electrical feedthrough (e.g., electrical feedthrough 306 of FIG. 3B) of the bulkhead 305*b* of the second (downhole) perforating gun 310*b*. Detonation may occur in a generally down-going fashion following the detonation signal, with the detonation of the second perforating gun 310*b* following detonation of the first perforating gun 310*a*. However, in examples, detonating of the various perforating charges of each individual perforating gun 310*a*, 310*b*, etc., may occur in an up-going direction. This may ensure that the detonation signal always proceeds to the next (downhole) perforating gun in a perforating gun assembly 102. For example, this exemplary configuration prevents scenarios in which a detonation signal is outpaced by the actual detonation of the detonation train, which could potentially result in only a partial detonation of the perforating gun assembly 102. Thus, the risk of detonation failure may be reduced by positioning detonator 360*a* of the first perforating gun 310*a* at the lower end of the gun, e.g., at least partially disposed within the bulkhead 305*b* of the second perforating gun 310*b*, as illustrated.

As mentioned, at least a portion of detonator housing 320*a* corresponding to the first perforating gun 310*a* may be disposed within a bulkhead 305*b* corresponding to the second perforating gun 310*b*. Coupling of a first perforating gun 310*a* to a second perforating gun 310*b* in this manner allows for reliable transmission of a detonation signal (e.g., from an initial firing signal) to propagate along one or more signal conductors (e.g., wires 346*a*, 346*b* in FIG. 3C) traversing the length of the perforating gun assembly 102, thus allowing serial detonation of each perforating gun of the perforating gun assembly 102.

Figure 3C:
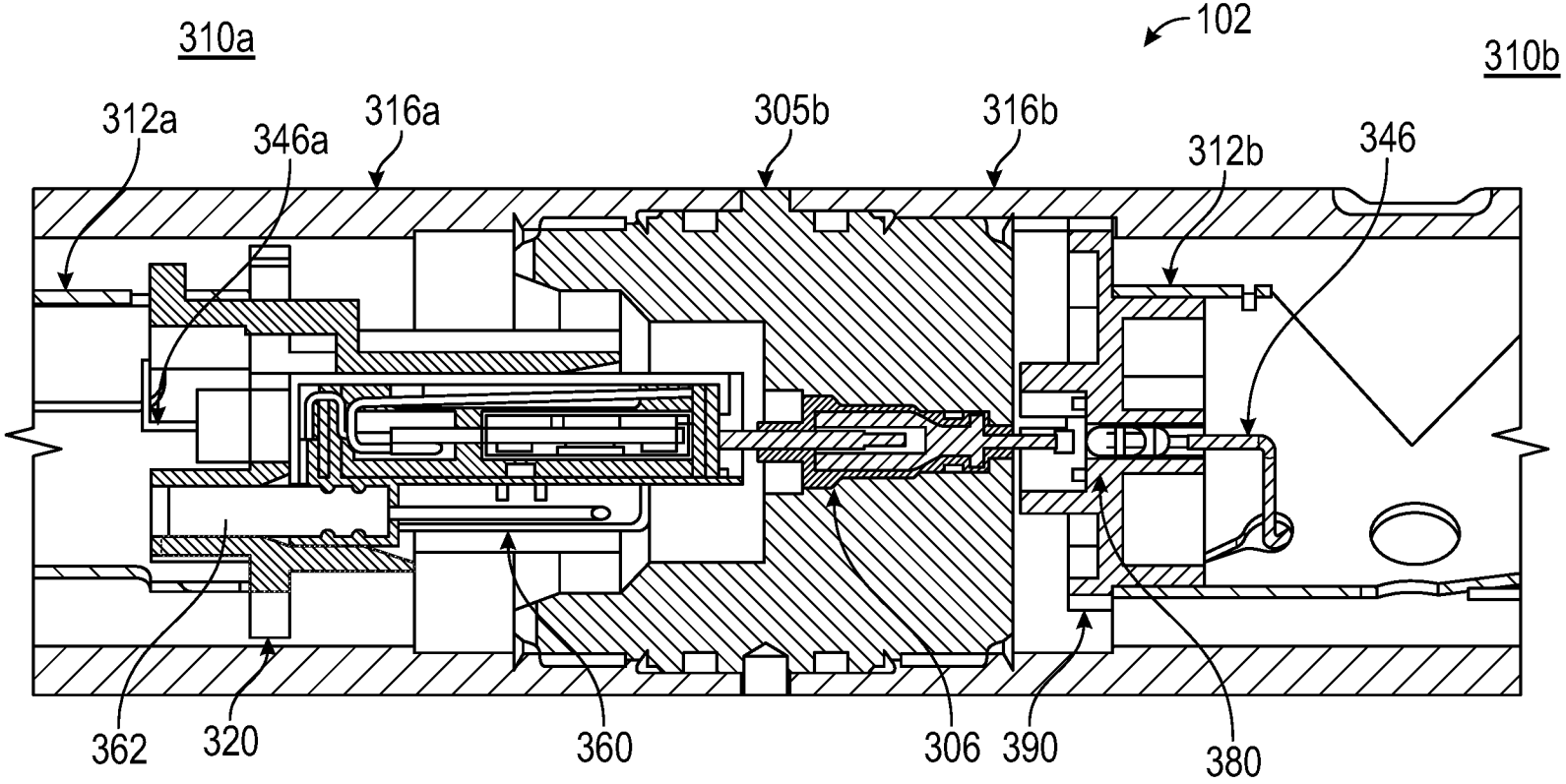
FIG. 3C is an enlarged section showing the connection between two perforating guns of FIG. 3B, in accordance with some examples of the present disclosure.

FIG. 3C is a close-up view of the section of FIG. 3B where the two perforating guns 310*a* and 310*b* are coupled together. As shown, the first gun body 316*a* is coupled to the second gun body 316*b* by a bulkhead 305*a* and an end alignment 390 of the second gun 310*b*. Also visible is the detonator housing 320 of the first perforating gun 310*a* housing a detonator 360, and an electrical contact 380 which electrically couples the two guns through an electrical feedthrough 306 of the bulkhead 305*a*, to be discussed later in detail. In operation, an electrical signal traveling through wire 346*a* of the first perforating gun 310*a* passes to the detonator 360 and explosive initiator 362 seated within the detonator housing 320 and ignites a detonating cord (e.g., detonating cord 540 in FIG. 5A) to trigger detonation of the first perforating gun 310*b*. As alluded to previously, the detonation signal then passes through an electrical feedthrough 306 of the bulkhead 305*b* of the second perforating gun 310*b* from where it enters an electrical contact 380, passes through an electrical feedthrough of an end alignment 390, and enters the next perforating gun 310*b* of the perforating gun assembly 102.

As mentioned previously, build-up of static charge within the detonator housing 320 may pose a risk to detonation by interfering with the detonation signal. To that end, a grounding clip is provided in FIG. 4A which may address at least in part this issue.

Figure 4A:
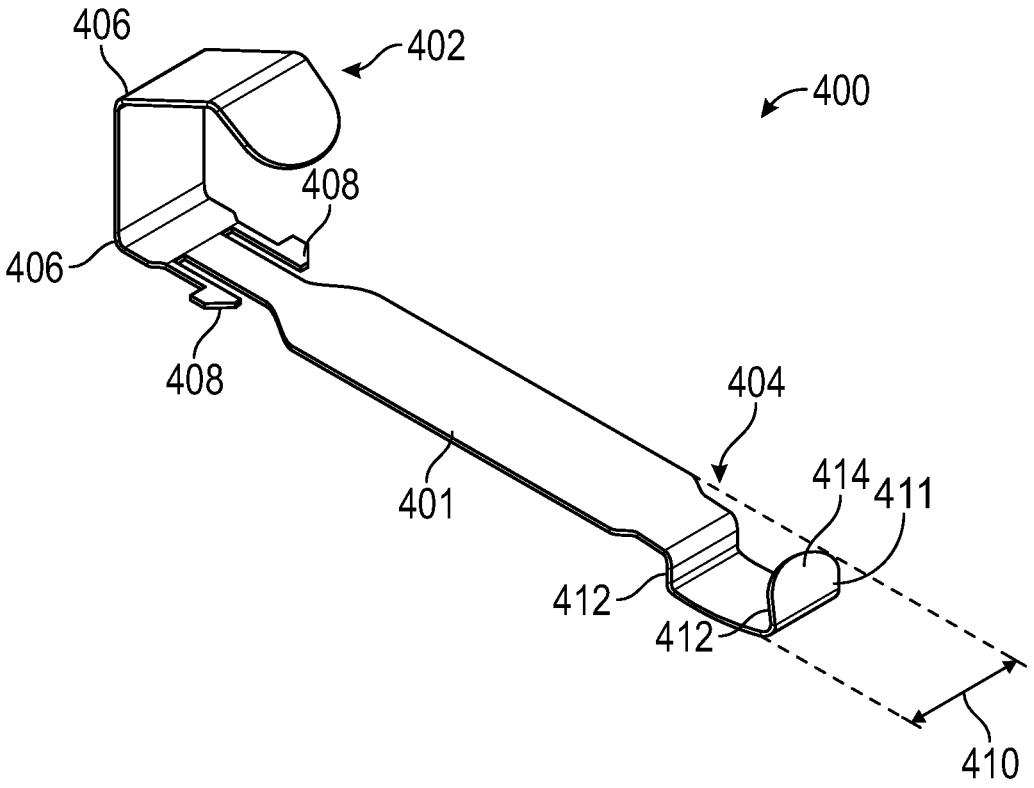
FIG. 4A is a grounding clip, in accordance with some examples of the present disclosure.

FIG. 4A shows a grounding clip 400, in accordance with examples of the present disclosure. As will be discussed in more detail below, the grounding clip 400 is secured to the detonator housing 320 (e.g., shown on FIG. 4B) to provide a ground to the gun body 316 (e.g., shown on FIG. 3A). The grounding clip 400 may comprise a single piece of conductive metal having an elongated body portion 401 with two consecutive inward bends 406 on the upper end 402 that lead to a ninety-degree bend towards the axial direction of the perforating gun 310 (e.g., shown on FIG. 3). Two wing features, or flexible locking tabs 408, from the elongated body portion 401 can be compressed towards the central axis of the grounding clip 400, which allow it to be seated within a slot (e.g., slot 418 on FIG. 4C), and deflect outwards resulting in a fixed retention method once installed. The feature of flexible locking tabs 408 allows for the apparatus to be axially locked into place once inserted into a mating slot of the detonator housing 320, to be discussed in later figures. In some examples, the flexible locking tabs 408 may also prevent personnel from accessing the connection between the detonator housing 320 and the charge tube 312 (e.g., shown on FIG. 3A) after assembly.

The grounding clip 400 has a width 410. On the lower end 404 of the grounding clip 400 opposite from the upper end 402, the grounding clip 400 has a reduced diameter portion 411 where the width 410 is reduced so that short bends 412 leading to a tapered bend 414 are angled in such a way for a mating contact point for grounding additional components. Specifically, the tapered bend 414 may provide an interference contact point so that the detonator housing 320 is grounded to a machined metal surface of the bulkhead 305*b* (e.g., referring to FIG. 3C). The inward bends 406 may also act as an upper contact point so that the upper end 402 makes an interference contact with a metal surface of the gun body 316 (e.g., referring to FIGS. 3A, 3C, 4A) when installed in a perforating gun 310 (e.g., referring to FIG. 4F).

Figure 4B:
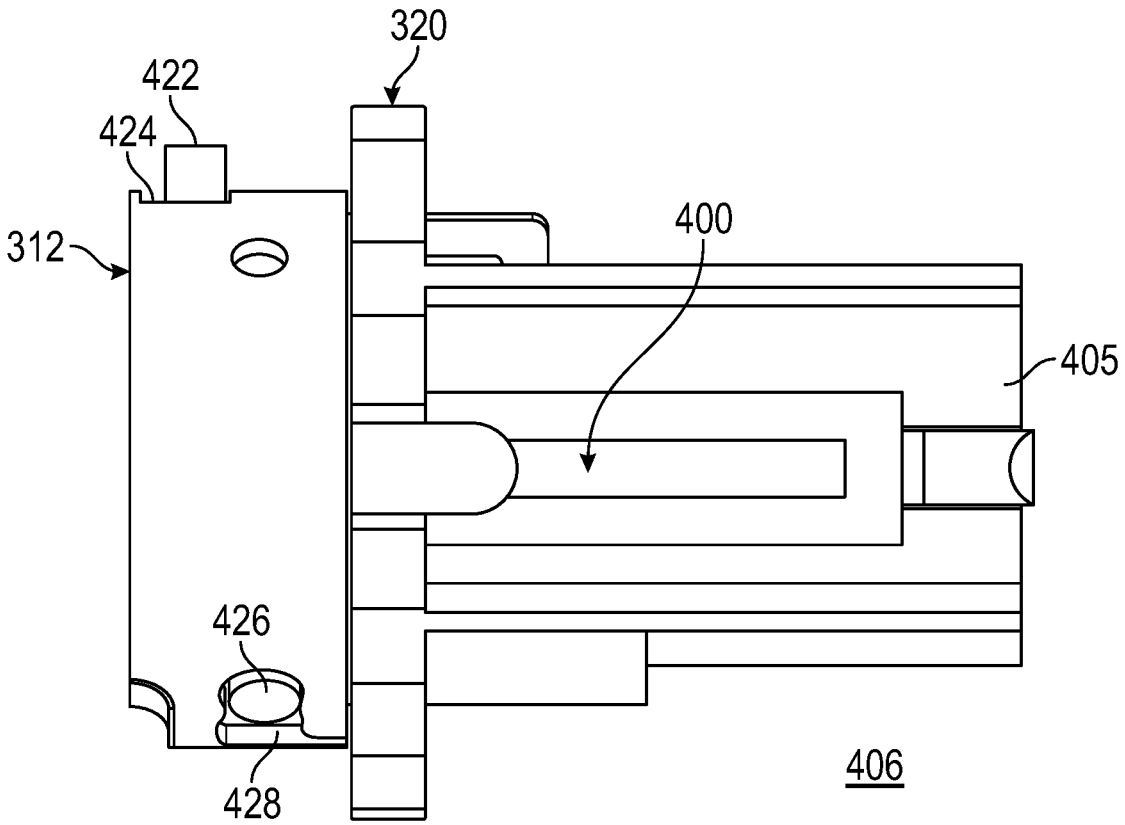
FIG. 4B is a top view of a charge tube and a detonator housing and which shows the grounding clip, in accordance with some examples of the present disclosure.

FIG. 4B is a top view of the charge tube 312 and detonator housing 320. As illustrated, the grounding clip 400 is secured in the detonator housing 320. Visible are both the upper end 402 and the lower end 404 of the grounding clip 400. As illustrated, the upper end 402 may wrap around a radial protrusion 321 of the detonator housing 320 while the lower end 404 ends beyond an axial end 405 of the detonator housing 320. As illustrated, when the perforating gun 310 is assembled, the upper end 402 may be seated against both the detonator housing 320 and the charge tube 312 such that it physically contacts both. In some examples, this design provides increased reliability for perforating gun systems by virtue of multiple grounding points. In one or more examples, the detonator housing 320 may comprise plastic.

Also visible in FIG. 4B is the collet 422 and lug 426 of the detonator housing 320 seated within openings 424 and 428 of the charge tube 312. As mentioned, these interlocking features may facilitate assembly and reduce or remove the need for external fasteners.

Figure 4C:
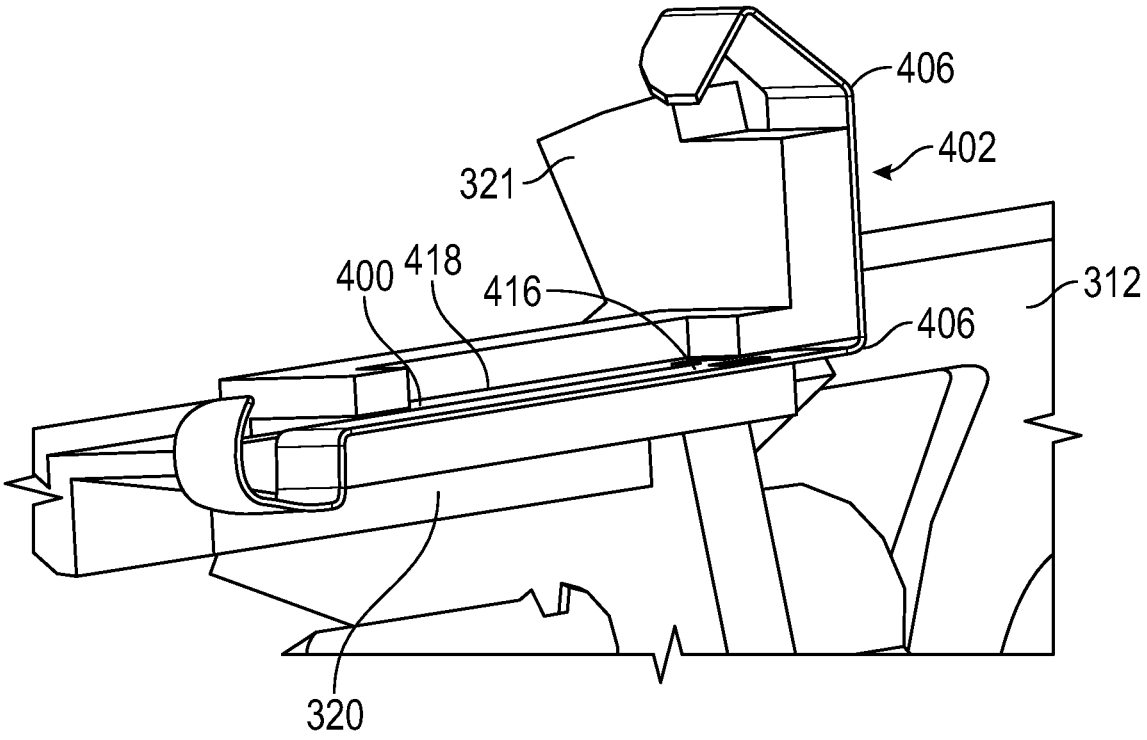
FIG. 4C is a perspective cross-sectional view of the detonator housing showing the grounding clip locked into place by a shoulder in a slot of the detonator housing, in accordance with some examples of the present disclosure.

FIG. 4C shows an angled cross sectional view of the detonator housing 320 and grounding clip 400. As illustrated, the flexible locking tabs 408 are locked into place by a shoulder 416, and the upper end 402 wraps around a radial protrusion 321 of the detonator housing 320. Also visible is the slot 418 within which the grounding clip 400 is inserted during assembly. During operation, the grounding clip 400 is held within the detonator housing 320 by the slot 418. As illustrated, the inward bends 406 of the grounding clip 400 may be oriented such that part of the upper end 402 is biased at an angle (e.g., 45 degrees) away from the detonator housing 320. This biasing of the upper end 402 away from the detonator housing 320 ensures that the upper end 402 maintains axial contact with the gun body 316 (e.g., referring to FIG. 3A). Specifically, the inward bends 406 may resist compression when the charge tube 312 and detonator housing 320 are housed by the gun body 316 (e.g., referring to FIG. 3A).

This axial contact with the gun body 316 ensures that multiple grounding pathways are provided through the apparatus by means of contact points between the elongated body portion 401 and the slot 418, between the upper end 402 and the gun body 316 (e.g., referring to FIG. 3A), and optionally, between the charge tube 312 and the grounding clip 400. These contact points may electrically couple the various conductive surfaces of the perforating gun 310 (e.g., referring to FIG. 3A) together, thereby providing an electrical pathway for static electricity away from the detonator housing 320.

Figure 4D:
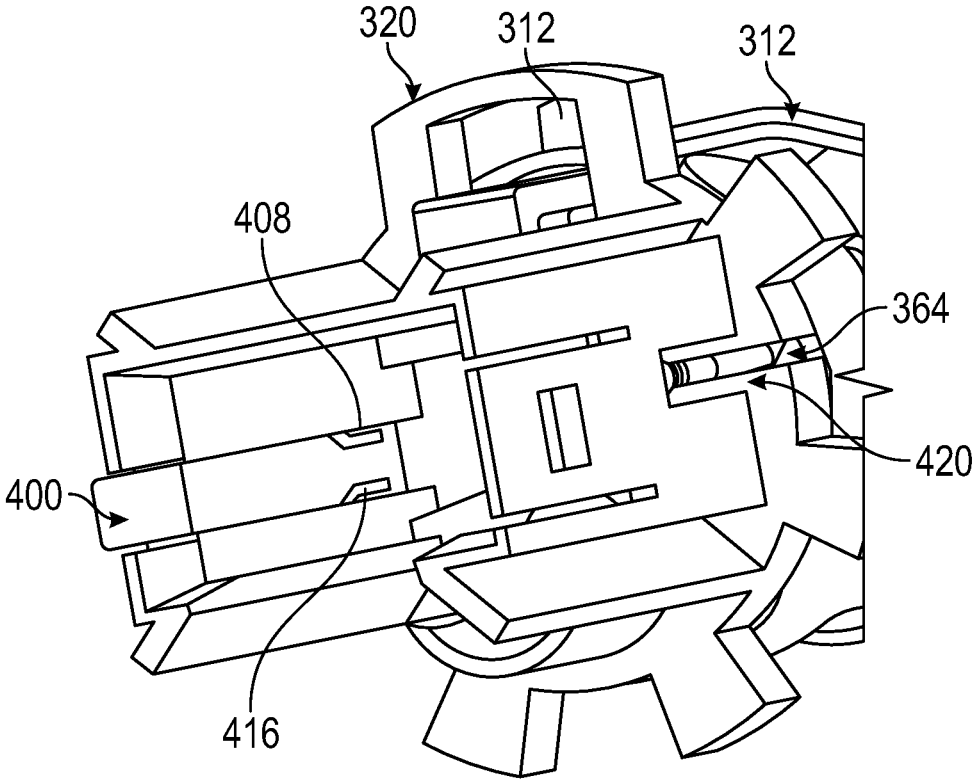
FIG. 4D is a perspective view of the detonator housing and charge tube from within detonator housing, with the detonator omitted for reference, to show the flexible locking tabs of the grounding clip in accordance with some examples of the present disclosure.

FIG. 4D is a view inside detonator housing 320, with the detonator omitted for reference. Visible are the flexible locking tabs 408 and shoulder 416, as well as the lower end 404 of the grounding clip 400. Also shown is the wire 346 which is electrically coupled to a pin 420 that seats in the detonator housing. In operation, the pin 420 passes the detonation signal from the wire 346 to the detonator 360 (e.g., referring to FIG. 4A). Use in this manner provides a good, reliable connection with the detonator 360. Also visible is a collet (e.g., collet 422 of FIGS. 4B, 4D, 6A) of the detonator housing 320 which interlocks the detonator housing 320 to the charge tube, to be discussed in more detail in later figures.

Figure 4E:
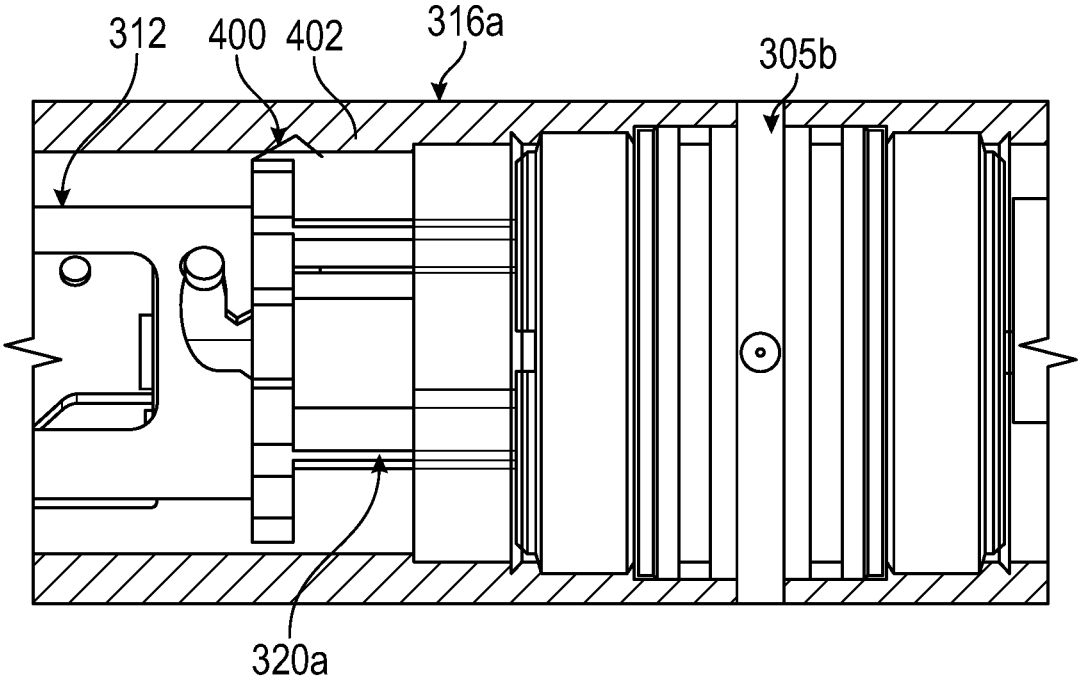
FIG. 4E is a side view of a portion of the perforating gun containing the detonator housing and bulkhead, with a portion of the gun body omitted for reference to show the grounding clip, in accordance with some examples of the present disclosure.

FIG. 4E is a semi-transparent view of the perforating gun assembly 102 (e.g., referring to FIG. 3B) that shows the charge tube 312 coupled together with the detonator housing 320*a* of the first perforating gun 310*a* (e.g., referring to FIG. 3B, 4A), which may be coupled to the bulkhead 305*b* of the second perforating gun 310*b*. In this figure, the upper end 402 of the grounding clip 400 is shown in a compressed state (e.g., 45 degrees or less relative to the central axis of the detonator housing 320). In some examples, the upper end 402 of the grounding clip 400 may be compressed such that it is less than 30 degrees relative to the central axis, and in some examples, flat against (parallel to) the gun body 316*a*. Thus, the grounding clip 400 may have, in some examples, a first configuration wherein the upper end 402 is biased at an angle greater than 30 degrees relative to a central axis of the perforating gun 310*a*, and a second configuration wherein the upper end 402 is biased at an angle less than 30 degrees relative to the central axis of the perforating gun 310*a*.

Figure 4F:
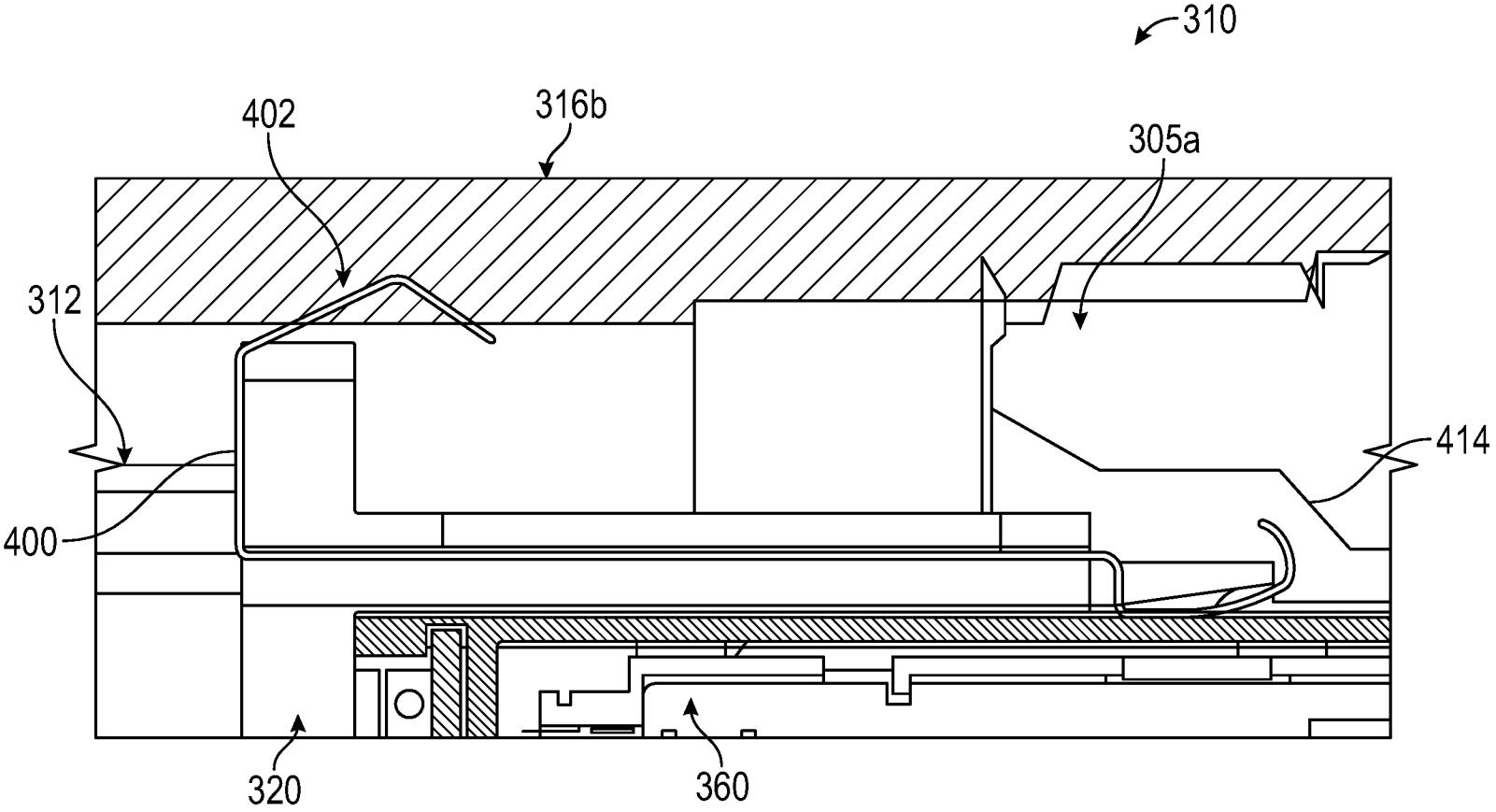
FIG. 4F is an enlarged, cross-sectional side view of the grounding clip disposed within the perforating gun and extending into a bulkhead of a second perforating gun, in accordance with some examples of the present disclosure.

FIG. 4F is a cross-sectional side view of the charge tube 312, detonator housing 320, and bulkhead 305. FIG. 4F shows the grounding clip 400. As mentioned, the upper end 402 of the grounding clip 400 may be compressed (not shown) by the gun body 316*b* such that it conforms to the longitudinal surface of the gun body 316*b* and exerts a spring-like force on the gun body 316*b*, ensuring good grounding between the two components. Tapered bend 414 may likewise be compressed upon connection of two neighboring perforating guns 310*a*, 310*b* (e.g., referring to FIG.

3B) such that a spring-like force is exerted on one or more regions of the bulkhead 305*a* (e.g., chamfered surface of an inner diameter thereof), as well as on the detonator housing 320 and/or detonator 360. Again, this ensures that the components of the perforating gun 310 are sufficiently grounded, thereby preventing or mitigating the likelihood of detonation failure upon firing of the detonation signal.

Figure 5A:
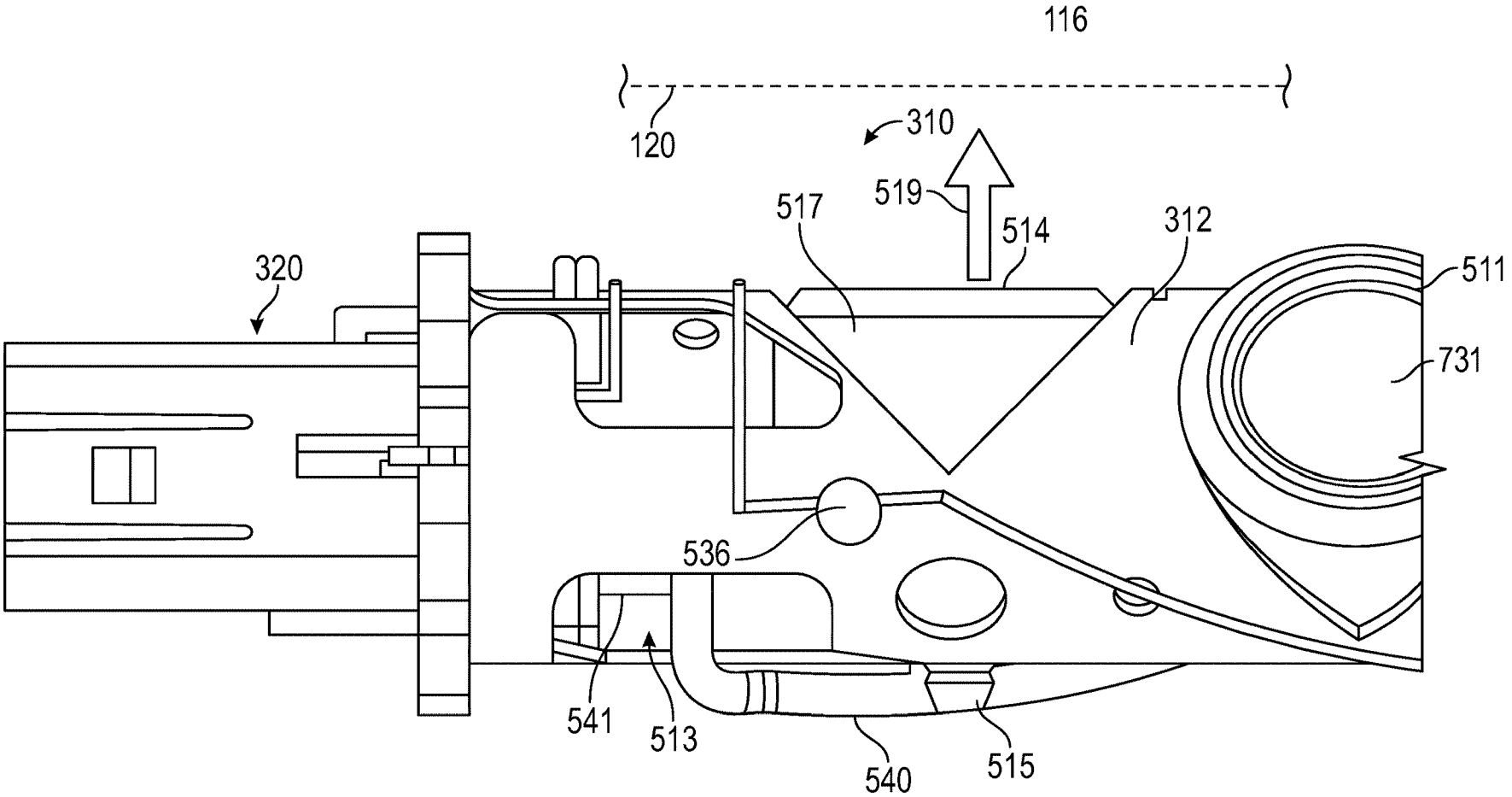
FIG. 5A is an enlarged side view of the detonator end of a perforating gun after a detonating cord has been installed and inserted into the detonator housing in accordance with some examples of the present disclosure.

FIG. 5A is an enlarged side view of the perforating gun 310 after a detonating cord 540 has been installed and inserted into the detonator housing 320. The detonating cord 540 may be arranged along the charge tube 312, such as by wrapping the detonating cord 540 around the charge tube 312 in a generally helical fashion and connecting the detonating cord 540 to each perforating section 514. Each perforating section 514 may include a charge case 517 containing an explosive charge for forming perforations in a borehole wall 120 (e.g., referring to FIG. 1) and an explosive booster at an initiation end 515. The explosive charge may be referred to as a "shaped charge" by virtue of a concave interior shape 511 of the charge case 517 that helps focus the explosive energy in a firing direction 319 directed toward the borehole wall 120. The detonating cord 540 may be laterally attached to each perforating charge at the initiation end 515 in a configuration for passing the explosive detonation from the detonating cord 540 to the booster and to the shaped explosive within the charge case 517. An end portion 541 of the detonating cord 540 is inserted through an window 513 on the charge tube 312 and secured to the detonator housing 320. The window 513 is also one of a variety of features that facilitate visually confirming insertion of the detonating cord 540 into the charge tube 312.

Figure 5B:
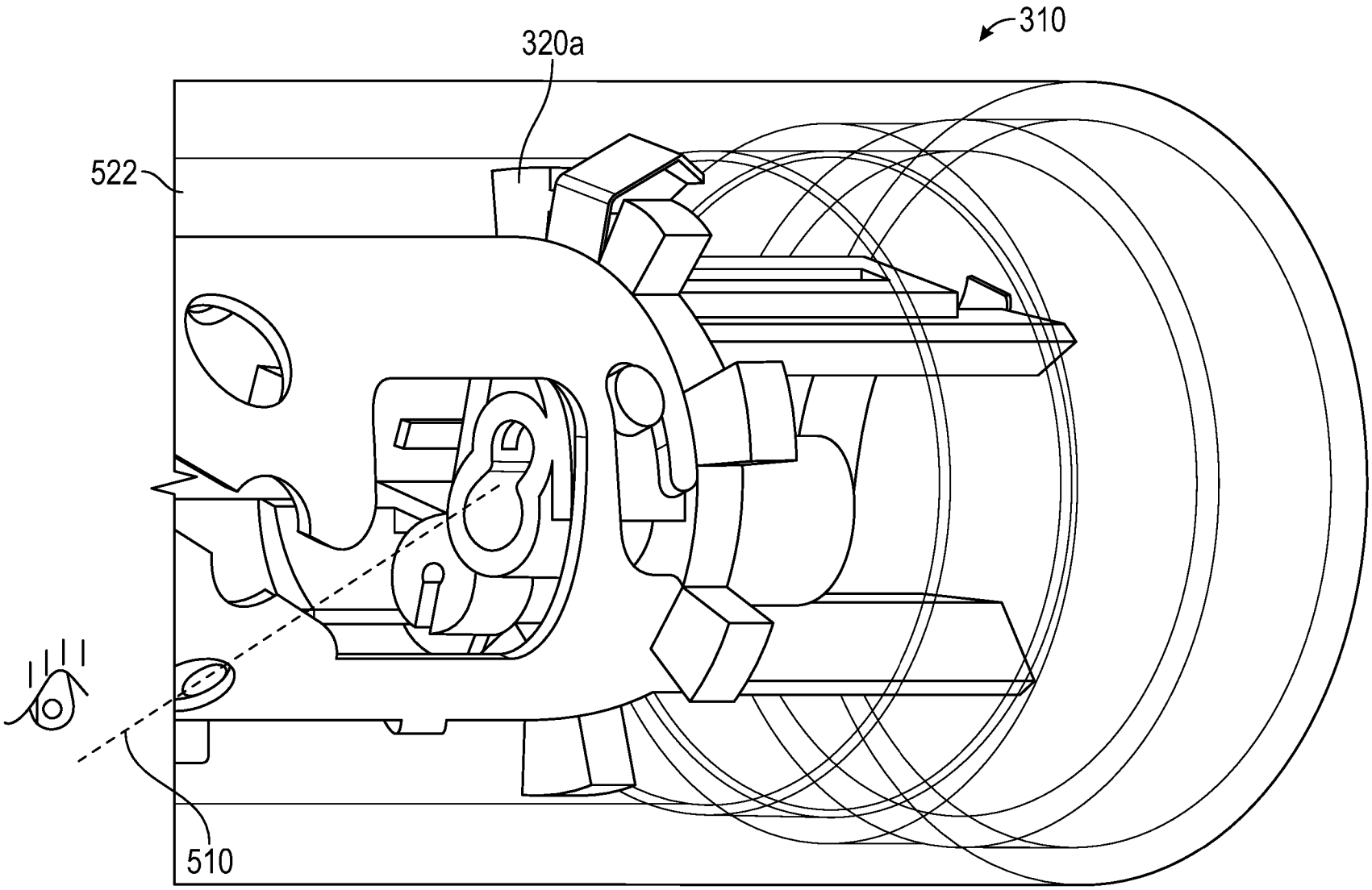
FIG. 5B is a perspective view of the perforating gun illustrating a first line of sight that may allow for visually confirming insertion of the detonating cord of FIG. 5A, in accordance with some examples of the present disclosure.

FIG. 5B is a perspective view of the perforating gun 310 illustrating a first line of sight 510 that may allow for visually confirming insertion of the detonating cord 540 of FIG. 5A. The first line of sight 510 is looking toward the detonator housing 320, through the window 513, from a proximate end 522 of the detonator housing 320. In this view, a detonating cord receptacle 526 and a detonator receptacle 528 can be seen for receiving a respective detonating cord and detonator as further discussed below.

These and other detonator components and assembly steps may be performed at least in part at a manufacturing facility, to reduce the number of steps to be completed in the field. Certain assembly steps, such as installing a detonator and making certain connections as part of the explosive train, may be deferred until the perforating gun 310 reaches the field, where the perforating gun 310 will be finally assembled and used. Deferring these steps helps avoid accidental detonation of the perforating sections 514 during transportation to the field. The actual order of assembly may vary due to the variety of different products that may incorporate these features, and the different markets, well sites, and so forth that will use the perforating gun 310. Regardless of location of assembly in the manufacturing facility or in the field, the assembler in the manufacturing facility, in the field, or wherever detonator components are installed will benefit from features that facilitate assembly. For example, features of the detonator housing 320 further disclosed below will help the assembler insert the end portion 541 of the detonating cord 540 to the proper depth and ensure the detonating cord 540 is fully and securely seated in the detonator housing 320.

Figure 5C:
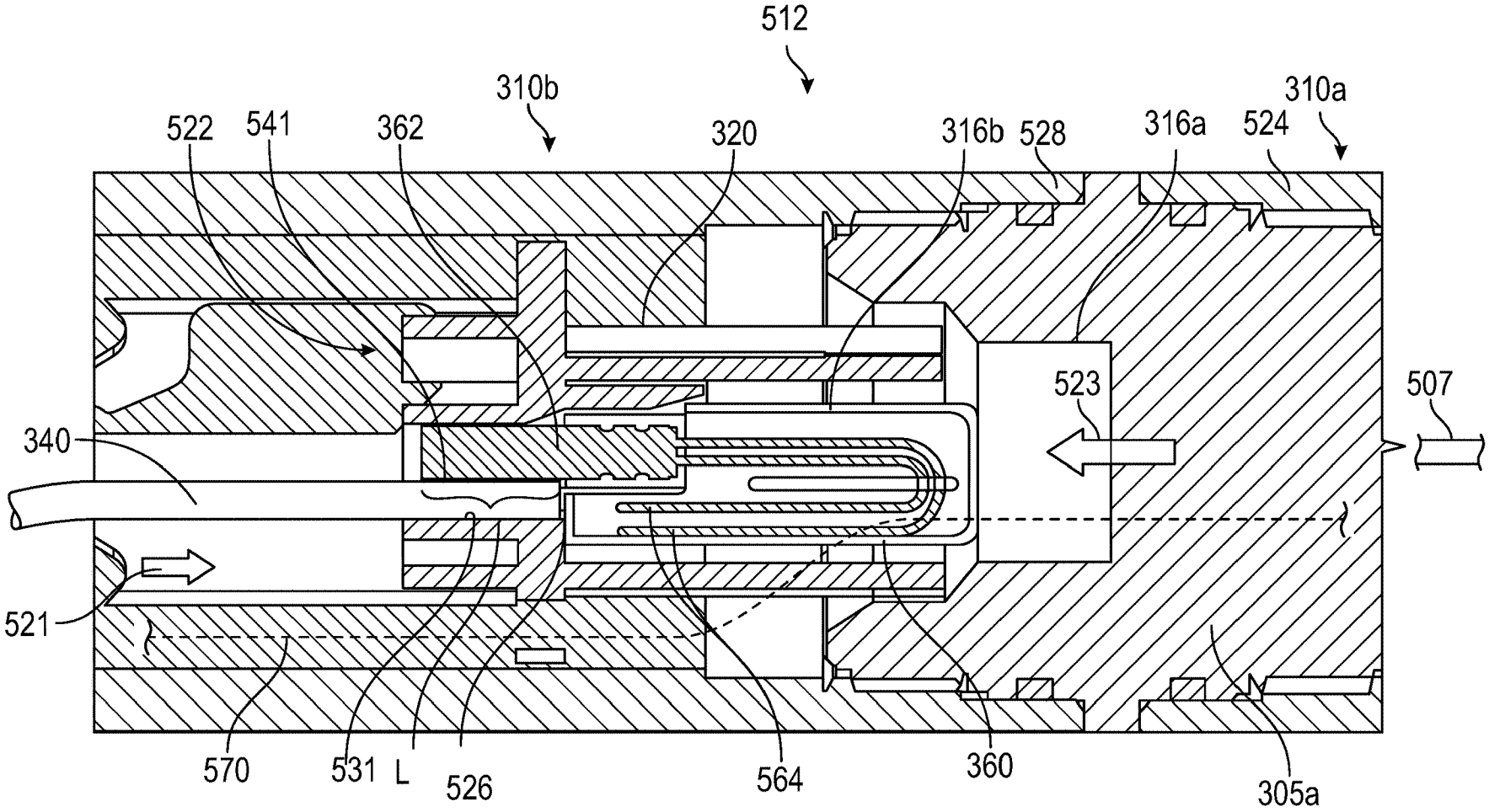
FIG. 5C is sectional side view of a perforating gun of FIGS. 3B, coupled end to end with a second perforating gun as part of a perforating gun string in accordance with some examples of the present disclosure.

FIG. 5C is sectional side view of the perforating gun 310*a* of FIGS. 3A and 3B, coupled end to end at the interface 512 (e.g., referring to FIG. 4) with a second perforating gun 310*b* as part of a perforating gun string, i.e., perforating gun assembly 102 (e.g., referring to FIG. 1), in accordance with one or more embodiments. The two perforating guns 310*a* and 310*b* are interconnected at their respective gun bodies 316*a*, 316*b* by any suitable connection type, e.g., threaded connections. A bulkhead 305*b* provides a physical barrier between the internal cavities of adjacent perforating gun bodies while providing electrical pathways therethrough. This may allow, in some examples, the perforating gun assembly 102 to quickly relay the detonation signal to the next gun while still maintaining good separation between the potentially high-pressure environments of the perforating guns 310*a*, 310*b* during detonation. Any number of additional perforating guns (not shown) may also be added to the perforating gun assembly 102.

In operation according to one or more examples, a detonation signal is relayed from a source (e.g., uphole electronics) down to the detonator 360. From the detonator 360, the detonation signal may proceed downhole to the next perforating gun 310*a* through the electrical feedthrough while detonating the explosive charges of the first perforating gun 310*b* in an up-going fashion. It should be understood that while detonating of the various perforating guns of the perforating gun assembly 102 (e.g., referring to FIGS. 1, 2, 4) may occur in a generally down-going fashion, detonation of the explosive charges of each perforating gun 310*a*, 310*b* may occur in an up-going fashion, as illustrated in the present example. Use in this manner may, in some examples, prevent a situation where the actual detonation outpaces the detonation signal, which would potentially interfere with signal transmission from gun to gun along the perforating gun assembly 102. This may ensure reliable detonation in some examples.

With continued reference to FIG. 5C, the perforating gun 310*a* has been further assembled by inserting the detonating cord 540 in one insertion direction 521 from a proximal end 522 of the detonator housing 320*a* and inserting the detonator 360 in an opposing insertion direction 523 from a distal end 524 of the detonator housing 320. The detonator receptacle 528 and detonating cord receptacle 526 are thus oppositely facing to receive the detonator 360 and detonating cord 540 from the opposing insertion directions 521, 523. The end portion 541 of the detonating cord 540 is received within a detonating cord receptacle 526 on the proximal end 522. A portion of the detonator 360 referred to as the explosive initiator 362 is received by a detonator receptacle 528 on the distal end 524 of the detonator housing 320. The explosive initiator 362 may comprise an explosive material inside a shell, wherein the shell is configured to fit closely within the detonator receptacle 528. With the detonating cord 540 fully seated within the detonating cord receptacle 526, and with the explosive initiator 362 of the detonator 360 fully seated within the detonator receptacle 528, the detonating cord 540 and explosive initiator 362 of the detonator 360 overlap by a desired overlap length "L", i.e., the detonating cord 540 and detonator 360 are in a side-by-side arrangement along this length L. The length "L" may be, for example, between 0.1 millimeters and 5 centimeters, or any ranges therebetween. The length "L" is of sufficient length to provide sufficient overlap between detonating cord 540 and detonator 360 to perform side-by-side detonation.

The detonator 360 is a part of the explosive train used to trigger an explosion of the perforating charges. The detonator 360 may generally comprise the explosive initiator 362, a body, one or more wires 564, and optionally, a wire clip. The detonator 360 may energize the detonation cord 340 to detonate the explosive charges upon receiving a detonation signal transmitted downhole to wires 564. For example, the detonation signal may be transmitted down a wireline schematically indicated at 507 to the perforating gun 310*b* from the surface of a wellsite. The explosive initiator 362 of the detonator 360 received into the detonator receptacle 528 may include a small amount of explosive material responsive to the electric signal. The explosive material may comprise a primary explosive and a secondary explosive. The primary explosive may be extremely sensitive to stimuli, such as an electrical signal in this case. The secondary explosive is typically a larger quantity of less sensitive explosive material that is triggered by the primary explosive. Any suitable explosive material can be used, as a variety of explosive materials for use in detonators are generally available. The overlap L ensures reliable transfer of detonation energy from the detonator 360 to the detonating cord 540. The detonating cord receptacle 526 also limits insertion as further discussed below to prevent further insertion of the detonating cord 540. Even without being able to see the end portion 541 of the detonating cord 540, the assembler can push the detonating cord 540 as far as it will go until it is fully seated, and thus be assured that the detonating cord 540 has been inserted to the intended depth and associated overlap L.

Thus, when the perforating gun 310 is assembled, the string of shaped charges is electrically connected inside the perforating gun bodies with the common detonation cord 340 used to explosively detonate the shaped charges in response to a detonation signal. The detonation cord 340 is connected to the detonator 360 housed in the perforating gun body 316. The detonator 360 may energize the detonation cord 340 to detonate the explosive charges within the respective perforating gun body 316 upon receiving the detonation signal. A separate signal conductor schematically indicated at 570 is formed through each perforating gun body 316*a*, 316*b*. The signal conductors 570 may comprise, for example, wire 346 (e.g., referring to FIG. 3), a flexible wire, an electric trace, or a ribbon, that is routed along each perforating gun body 316*a*, 316*b* to a signal input on each detonator 360. In one or more examples, one or more signal conductors 570 may be wrapped helically around the charge tube 312. The signal conductors 570 are interconnected via the connection between each pair of adjacent perforating guns to form a continuous signal path for communicating electrical signals from the wireline 507, along the perforating gun assembly 102, and to each detonator 360. The location of the detonator 360, and the routing of the detonating cord 540 and signal conductors 570 within each perforating gun body 316*a*, 316*b*, are illustrated by way of example and may vary according to the design of the perforating gun selected.

Figure 5D:
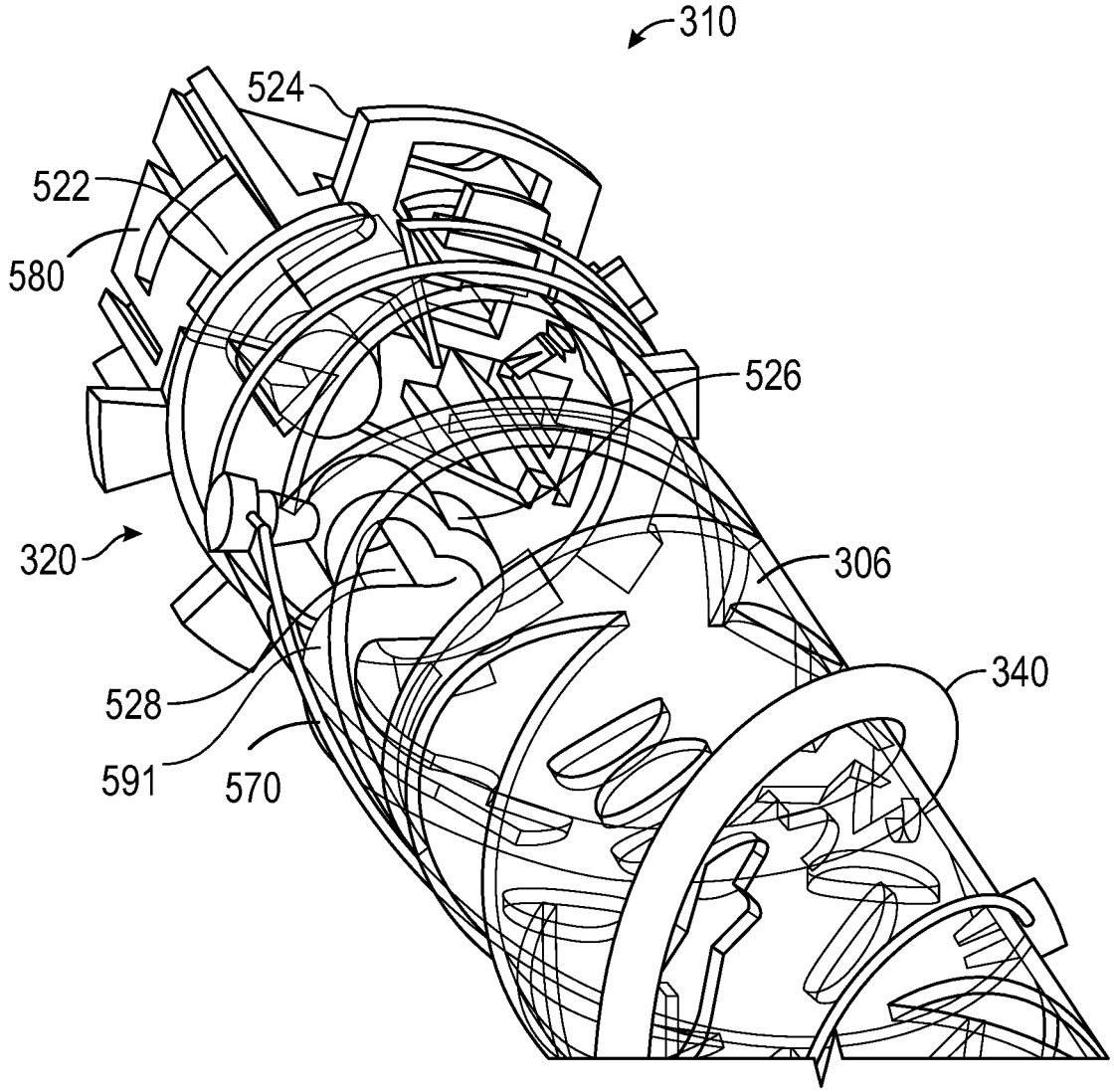
FIG. 5D is a perspective view of the perforating gun rotated away from the orientation of FIG. 5C, in accordance with some examples of the present disclosure.

FIG. 5D is a semi-transparent view of the perforating gun 310 rotated away from the orientation of FIG. 5C to show various features from another angle. It can be seen, for example, how the detonating cord 540 is wrapped in an optionally helical arrangement about the charge tube 312 and how the end portion 541 of the detonating cord 540 enters the detonating cord receptacle 526. The detonator (e.g., detonator 360 of FIG. 5C) is omitted for reference in this view so that the detonator receptacle 528 is shown unoccupied. This view provides another perspective of how the detonating cord receptacle 526 is generally aligned with the detonator receptacle 528 in a parallel, side-by-side arrangement. Also visible is the detonator housing 320, signal conductor 570 (e.g., wire) wrapped helically around the charge tube 312, a male end 580 of a "click-lock" type fastener, as well as the proximate end 522 of the detonator housing 320. The distal end 524 would be visible when viewed from behind the detonator housing 320 relative to the perspective shown in the figure. Also, as illustrated, the detonating cord 340 may be wrapped around the charge tube 312, except for where it enters through an aperture of the charge tube 312 at the bend 591 so that it may be routed from without the charge tube 312 to within the charge tube 312 and to the detonating cord receptacle 526.

Figure 6A:
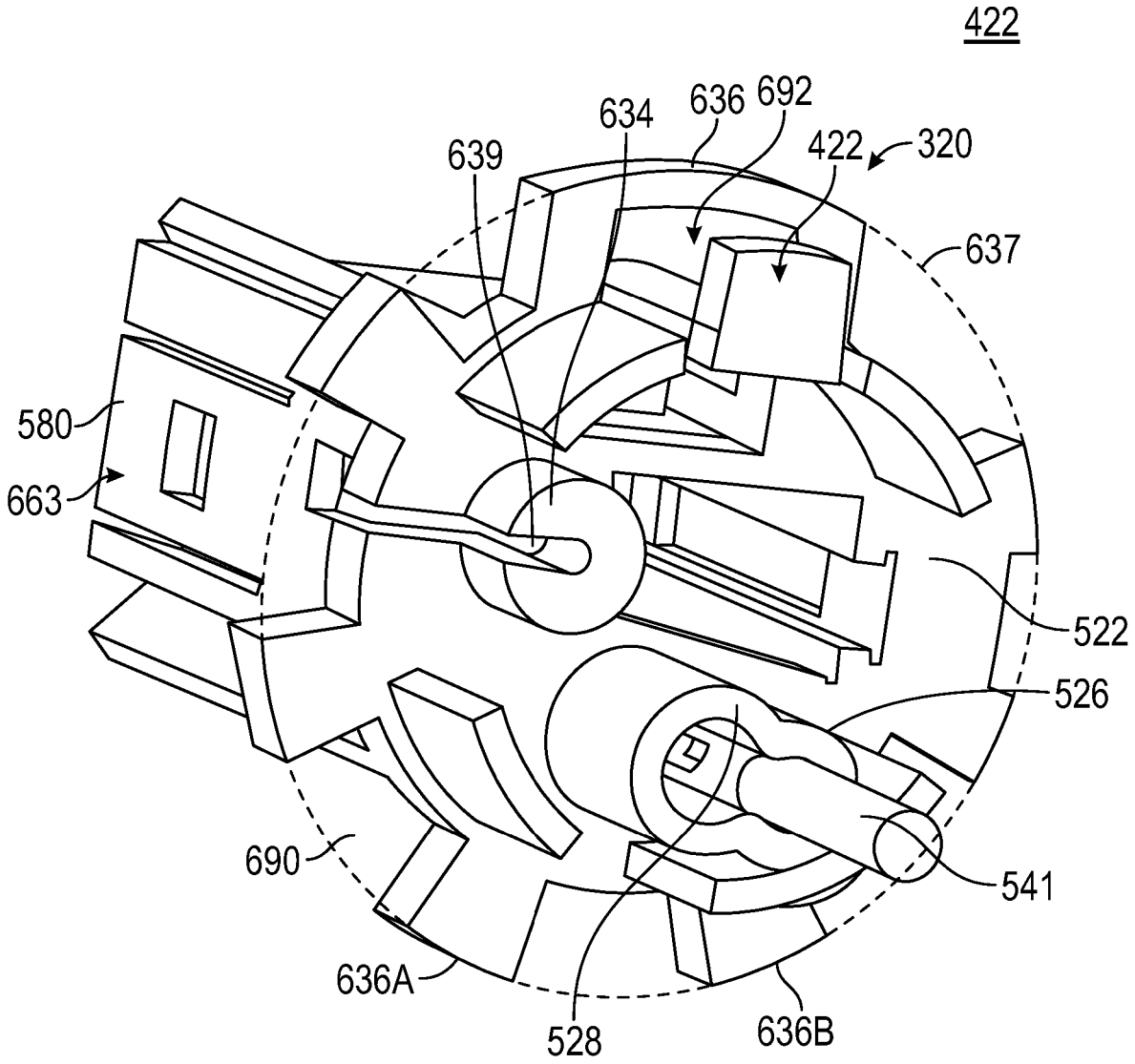
FIG. 6A is a perspective view of the detonator housing facing the proximate end, with the charge tube and other components of FIG. 5D omitted, in accordance with some examples of the present disclosure.

FIG. 6A is a perspective view of the detonator housing 320 (e.g., referring to FIGS. 3A-3G) facing the proximate end 522, with the charge tube and other components of FIG. 5D omitted for discussing certain example features of the detonator housing 320, in accordance with one or more embodiments. These other features include a click-lock type fastener 663 for releasably securing a body of the detonator housing 320 within the charge tube 312 of FIGS. 3A-3G. A raised boss 434 with a pin hole 639 is provided for receiving an electrical pin (not shown) for electrically coupling components of an electrical communication pathway along the perforating gun and/or gun string. The electrical pin may serve to electrically couple one or more electrical conduits (e.g., wires) to an electrical feedthrough of the bulkhead, wherethrough a signal may proceed from gun to gun of the perforating gun assembly 102 (e.g., referring to FIG. 1). A periphery 636 of the detonator housing 320 may define an outer diameter of the detonator housing 320. The periphery 636 may include a plurality of non-contiguous peripheral portions, e.g., ears 636A, 636B, etc., circumferentially spaced along a generally circular profile indicated by a dashed line at 637 that may conform to an inner diameter of a charge tube or other outer perforating gun component. The end portion 541 of the detonating cord is shown partially inserted into the detonating cord receptacle 526.

As mentioned, a "click-lock" type fastener 663 may releasably secure a body of the detonator housing 320 within the charge tube 312 of FIGS. 3A-3G. The click-lock type fastener 663, part of which is also visible in each of FIGS. 3C, 3D, and 3G, may be unitarily formed as part of the detonator housing 320, or else made up of one or more separate pieces.

The click-lock type fastener 663 may have a male end 580 to clip into a receiving end (not shown) of the charge tube 312, or vice versa.

Figure 6B:
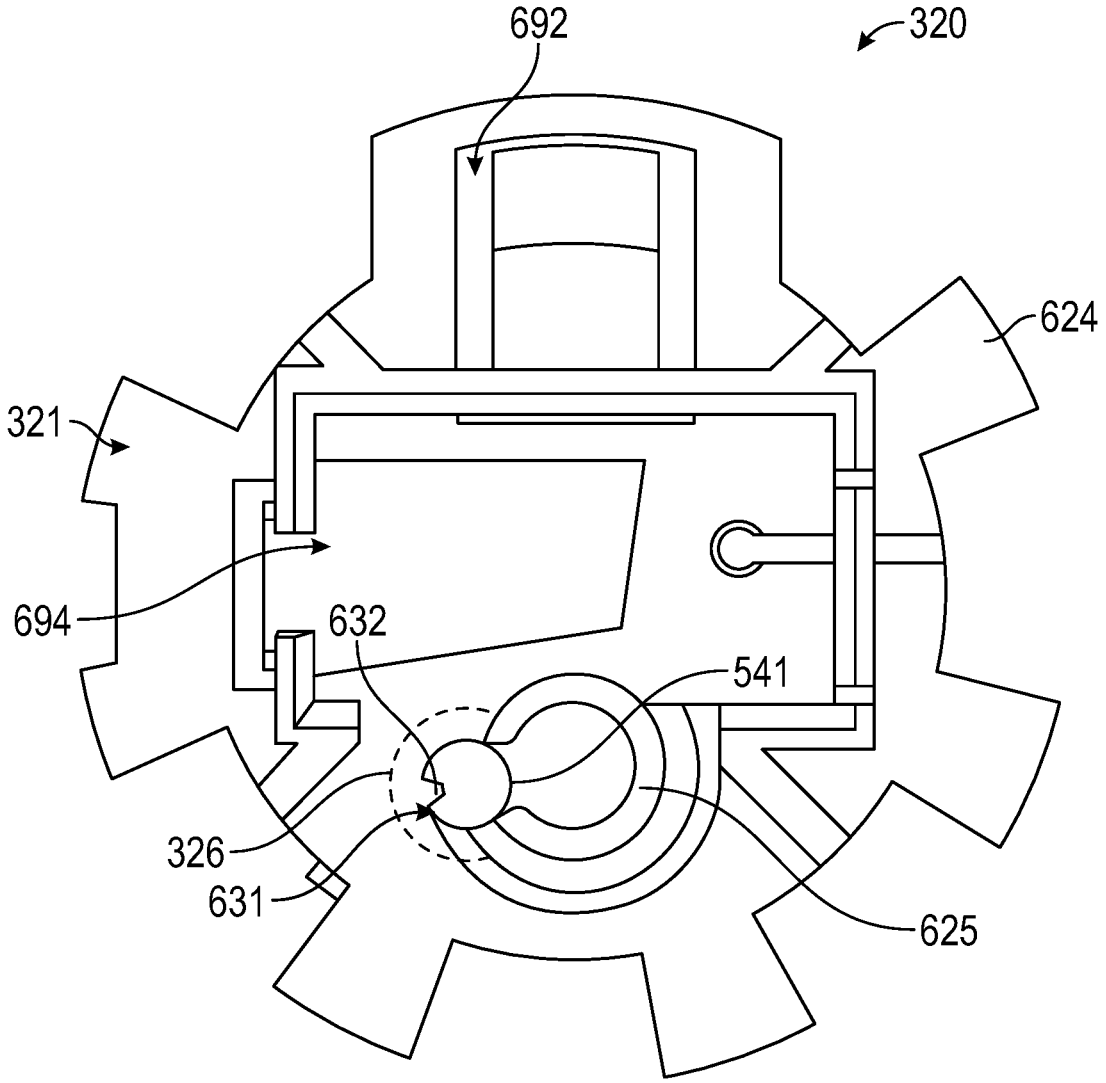
FIG. 6B is an end view of the detonator housing as viewed from the distal end of FIG. 6A with the end portion of the detonating cord inserted for reference, in accordance with some examples of the present disclosure.

FIG. 6B is an end view of the detonator housing 320 facing the distal end 524 (i.e., flipped around from FIG. 6A) with the end portion 541 of the detonating cord inserted for reference, in accordance with one or more embodiments of the present disclosure. This view shows one example configuration of a detonating cord stop 631 formed on the detonating cord receptacle 526 (shown by a dotted line) to limit an insertion depth of the detonating cord within the detonating cord receptacle 526, i.e., a depth locating feature. The detonating cord stop 631 comprises a single inward radial protrusion 632 in this example, but may include additional (i.e., a plurality of) radial protrusions circumferentially spaced around the detonating cord receptacle 526 to limit insertion of the end portion 541 of the detonating cord from the proximal end 522 of FIG. 6A. The radial protrusion 632 can be unitarily formed as part of the detonating cord receptacle 526, along with any of the other features, such as by injection molding, additive manufacturing (i.e., 3D printing), or the like. Alternatively, the detonating cord stop 631 may comprise a separate piece housed within or attached to the detonating cord receptacle 526, such as but not limited to over molding, fastening, snap fitting, or other methods of joining. The detonator receptacle 528 is shown with the detonator omitted in this view. The detonator receptacle 528 may also include a detonator stop 625 of any suitable configuration to similarly limit insertion of the explosive initiator 362 of the detonator from the proximal end 624. In the example shown, the detonator stop 625 is a depth locating feature similar to detonating cord stop 631 and is a single circumferential inward protrusion that partially covers the detonator receptacle 528. Partial covering the detonator receptacle 528 with the detonator stop 625 (e.g., allowing for an unobscured portion) may allow, in some examples, for the assembler to view from the proximate end if the detonator is inserted to its appropriate insertion distance.

Figure 6C:
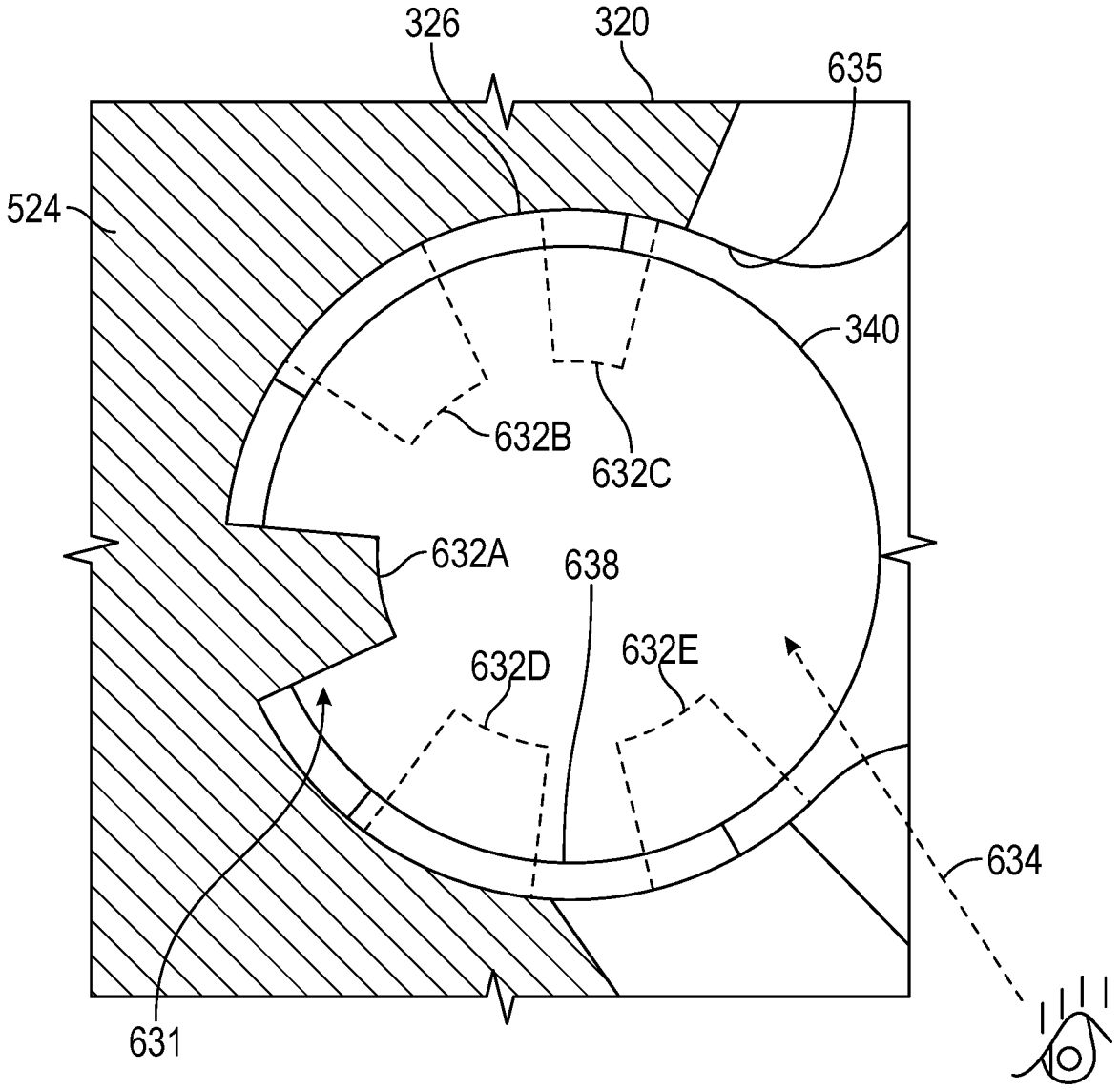
FIG. 6C is an enlarged end view of the detonator housing as viewed from the distal end of FIG. 6A, wherein the detonating cord stop comprises one or more inward radial protrusions, in accordance with some examples of the present disclosure.

FIG. 6C is an enlarged end view of the detonating cord receptacle 526 of detonator housing 320 as viewed from the distal end 524 of FIG. 6A, wherein the detonating cord stop 631 comprises one or more radial protrusions 632A-632E to limit the insertion depth of the detonating cord 540, in accordance with one or more embodiments. Again, the detonating cord stop 631 (e.g., referring to FIG. 6B) may include as few as one radial protrusion 632A as shown in solid line type. The detonating cord stop 631 may alternatively include a plurality of inward radial protrusions, e.g., 632A-632E, circumferentially spaced about a circular opening 635 of the detonating cord receptacle 526. The detonating cord stop 631 at least partially covers the opening 635 and has sufficient strength and rigidity to prevent the detonating cord 540 from being easily inserted beyond the detonating cord stop 631. The portion of the opening 635 not obscured by the detonating cord stop 631 provides a second line of sight schematically indicated at 634, to allow an assembler, as viewing from the distal end 524, to visually confirm when the detonating cord 540 has been fully inserted. Thus, the assembler(s) has/have at least two lines of sight, one from the proximal end and one from the distal end, to help visually confirm seating of at least the detonating cord 540, and optionally, the explosive initiator 362 (e.g., referring to FIG. 5C).

As another optional feature of the detonating receptacle 526, one or more ribs 638—in this case, two ribs—are provided to help guide insertion of the detonating cord 540. The ribs 638 protrude radially far enough into the opening 635 to frictionally engage the detonating cord 40 while still allowing the detonating cord 540 to be slid beyond the ribs 638 axially until it engages with the radial protrusion(s) 632 of the detonating cord stop 631. The ribs 638 can help secure the end portion of the detonating cord 540 within the opening 635, at least by virtue of this frictional engagement, so as to prevent the detonating cord 540 from being accidentally removed from the detonating cord receptacle 526. Preventing accidental removal from detonating cord receptacle 526 may be important, as subsequent detonation of the next perforating gun in a gun string (perforating gun assembly) may be interrupted in some examples by an improperly installed detonation cord 340, resulting in an incomplete detonation of the detonation train. In addition, preventing over-insertion of the detonating cord 540 with the detonating cord stop 631 may also help ensure good detonation and thus complete detonation of the detonation train by preventing the detonating cord 540 from being inserted too far into detonating cord receptacle 526. For example, if only the end of the detonating cord 540 is the active region of the detonating cord 540, (e.g., due to insulation material wrapped around inactive regions), over-insertion of the detonating cord 540 may similarly result in a failure to detonate just as in the case of insufficient insertion. Another function potentially served by the ribs 638 is to apply a normal force to the detonating cord 540 when it is side by side with and pressed up against the initiator. This may ensure good contact between the detonating cord 540 and the detonator to ensure good detonation.

Figure 6D:
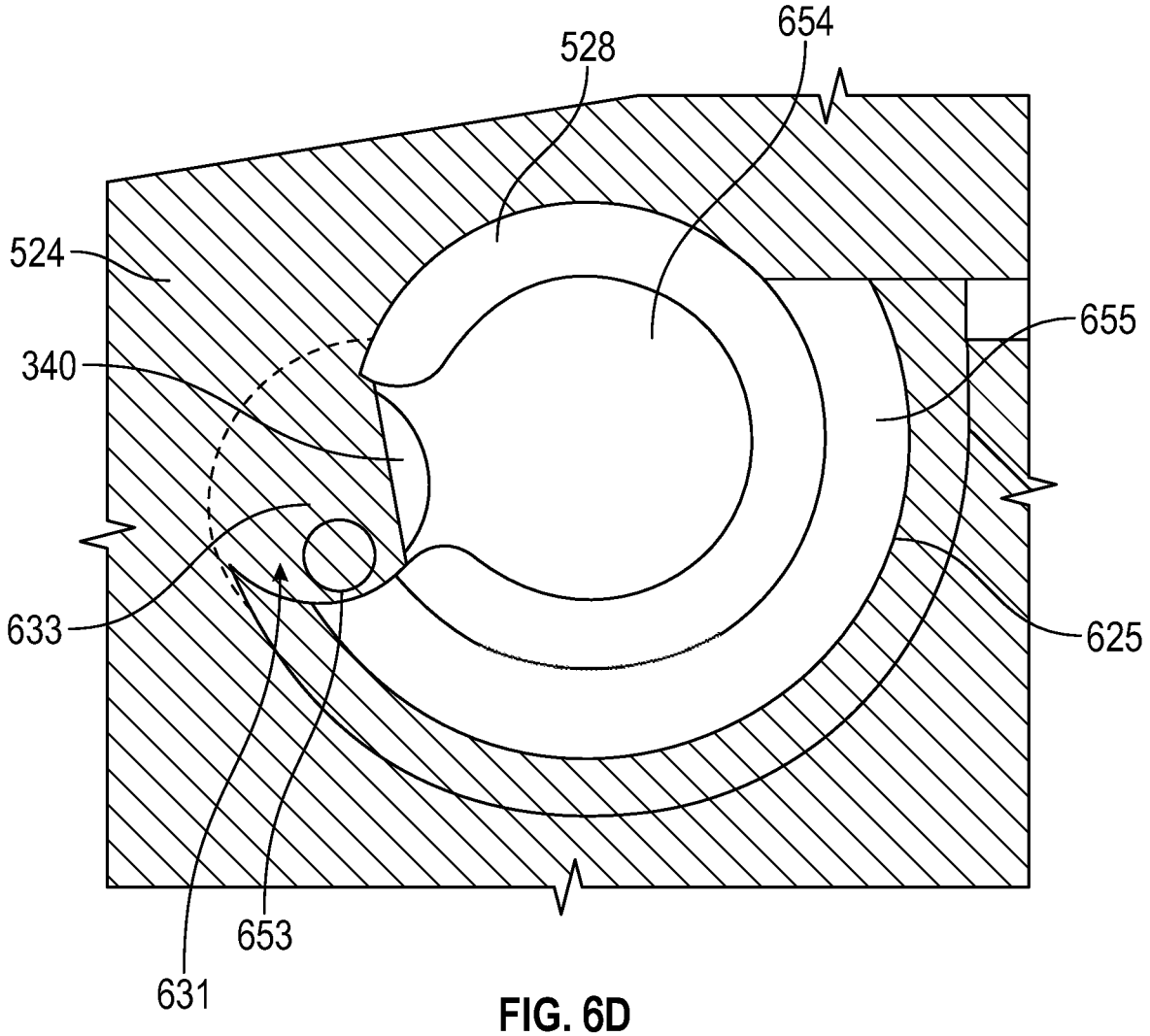
FIG. 6D is an enlarged end view of the detonator housing as viewed from the distal end of FIG. 6A, wherein the detonating cord stop comprises one or more thin webs, in accordance with some examples of the present disclosure.

FIG. 6D is an enlarged end view of the detonator housing 320 as viewed from the distal end 524 of FIG. 6A and showing both detonating cord receptacle 526 and detonator receptacle 528, in accordance with one or more embodiments. In the example shown by this figure, rather than inward radial protrusion(s) 632A-832E, the detonating cord stop 631 alternatively (or additionally) comprises a thin web 633 that functions in a similar manner to limit insertion of the detonating cord 540 past the detonating cord stop 631. As with the inward radial protrusion(s) 632A-832E, the thin web 633 has sufficient strength and rigidity to prevent the detonating cord 540 from being easily inserted beyond the detonating cord stop 631. The thin web 633 may at least partially cover the opening 635 (e.g., referring to FIG. 6C). As illustrated, thin web 633 may cover the majority of (i.e., at least half of the cross-sectional area of) opening 635, for additional security against over-insertion. Alternatively, thin web 633 may cover only a fraction, for example, about 20% to about 90%, or any ranges therebetween, of the cross-sectional area of opening 635. The web 633 could, in one or more embodiments, cover the entire opening 635. However, covering only part of the opening 635 allows an assembler, as viewing from the distal end 524, to visually confirm when the detonating cord has been fully inserted. For example, thin web 633 may comprise one or more tapered sections 652 or cut-out sections 653 to allow for a line of sight. Thin web 633 may have any suitable shape. The thickness of the thin web 633 (i.e., as measured into the plane of the drawing view) may be selected to provide the desired rigidity, for example, about 0.1 millimeters to about 1 centimeter, or any ranges therebetween. Also as illustrated, the detonator stop 625 is disposed within an opening of the detonator receptacle 528, for example, on the end of the detonator receptacle 528 closest to the proximal end of the detonator housing 320.

Figure 6E:
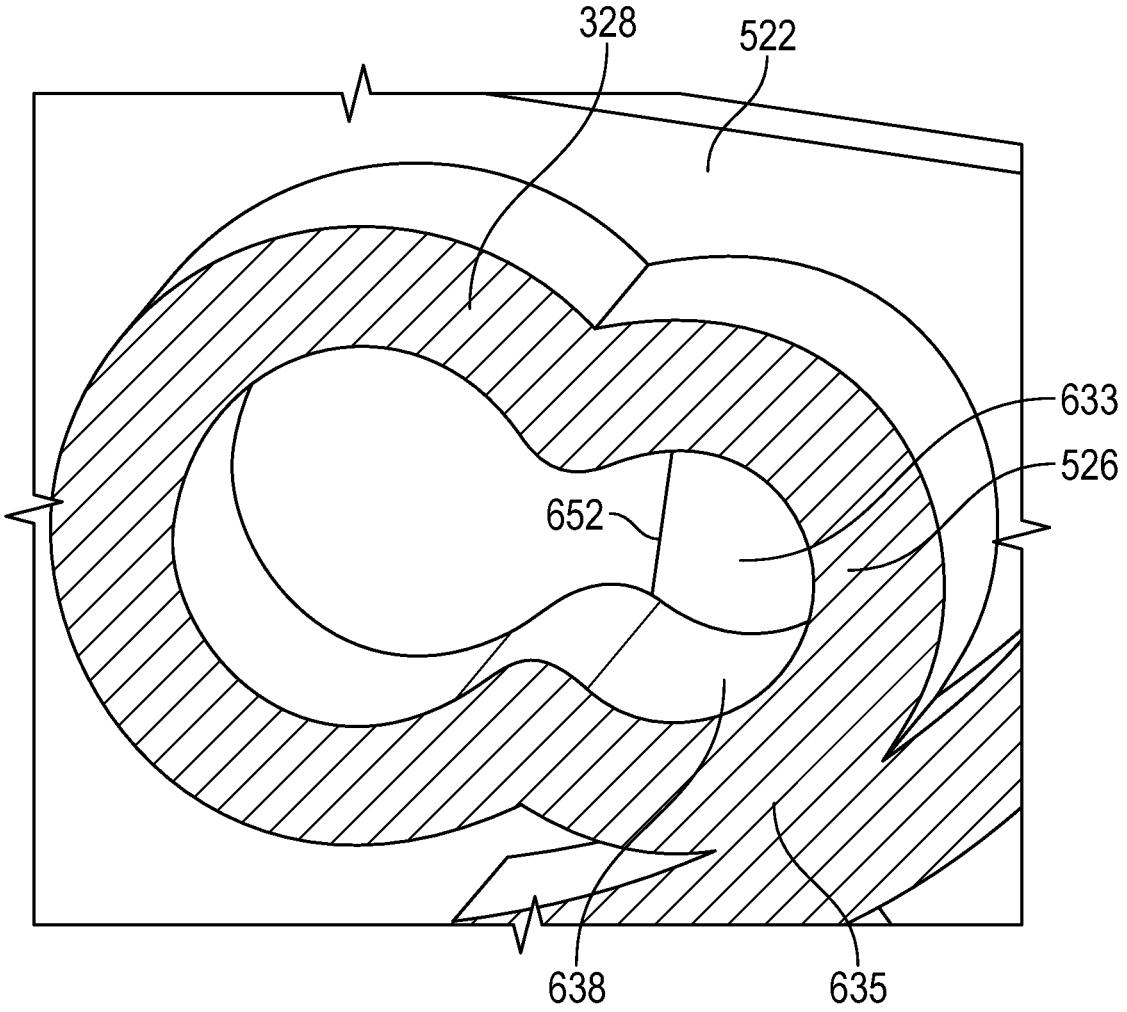
FIG. 6E is an enlarged perspective view of the detonating cord receptacle and detonating cord stop, as viewed from the proximal end of the detonator housing and with the detonating cord omitted for reference, in accordance with some examples of the present disclosure.

FIG. 6E is an enlarged view of the detonator housing 320 as viewed from the proximal end 522 (e.g., inside the gun body) and showing both detonating cord receptacle 526 and detonator receptacle 528, in accordance with one or more examples. This example shows one example configuration of the detonating cord receptacle 526 shown in FIG. 6D wherein the detonating cord stop 631 comprises a thin web 633 extending radially inwardly to cover a majority of the opening 635 of the detonating cord receptacle 526. This thin web 633 covers at least part of the opening sufficient to prevent the detonating cord from being inserted past the thin web 33 in an insertion direction from the proximal end 522 toward the distal end.

As illustrated, the cross-sectional area of detonating cord receptacle 526 is smaller than that of the detonator receptacle 528. This is due to the fact that the circumference of the detonator is larger than the that of the detonating cord 340, and the two are meant to fit snugly against each other in their respective receptacles 526, 528. However, it is contemplated that in the event that detonation is performed with a smaller explosive initiator 362 (e.g., referring to FIG. 3), the cross-sectional area of the detonating cord receptacle 526 may be larger than that of the detonator receptacle 528 to ensure proper side by side detonation. Also, while not illustrated, the one or more ribs 638 shown and described in FIG. 6C may also be present within opening 635 when the thin web 633 is used instead of or in addition to the one or more inward radial protrusion(s) 632A-832E (e.g., referring to FIG. 6C), for providing frictional engagement to the detonating cord 340. Likewise, while not shown, similar ribs may be used within the detonator receptacle 528 to frictionally engage the explosive initiator 362 to ensure reliable seating of the detonator within the detonator housing 320.

The detonator 360 is a part of the explosive train used to trigger an explosion of the perforating charges. The detonator 360 may energize the detonation cord 340 to detonate the upon receiving a detonation signal transmitted downhole to wires 564. For example, the detonation signal may be transmitted down a wireline schematically indicated at 507 to the perforating gun 310*b* from the surface of a wellsite. In the example shown, the detonation signal that arrives at detonator 360 first passes through bulkhead 305*a* of a perforating gun 310*a* disposed uphole from perforating gun 310*b*. The explosive initiator 362 of the detonator 360 received into the detonator receptacle 528 may include a small amount of explosive material responsive to the electric signal. The explosive material may comprise a primary explosive and a secondary explosive. The primary explosive may be extremely sensitive to stimuli, such as an electrical signal in this case. The secondary explosive is typically a larger quantity of less sensitive explosive material that is triggered by the primary explosive. Any suitable explosive material can be used, as a variety of explosive materials for use in detonators are generally available. The overlap L ensures reliable transfer of detonation energy from the detonator 360 to the detonating cord 540. The detonating cord receptacle 526 also limits insertion as further discussed below to prevent further insertion of the detonating cord 540. Even without being able to see the end portion 541 of the detonating cord 540, the assembler can push the detonating cord 540 as far as it will go until it is fully seated, and thus be assured that the detonating cord 540 has been inserted to the intended depth and associated overlap L.

Thus, when the perforating gun 310 is assembled, the string of shaped charges is electrically connected inside the perforating gun bodies with the common detonation cord 340 used to explosively detonate the shaped charges in response to a detonation signal. The detonation cord 340 is connected to the detonator 360 housed in the perforating gun body 316. The detonator 360 may energize the detonation cord 340 to detonate the explosive charges within the respective perforating gun body 316 upon receiving the detonation signal. A separate signal conductor schematically indicated at 570 is formed through each perforating gun body 316*a*, 316*b*. The signal conductors 570 may comprise, for example, a flexible wire, an electric trace, or a ribbon, that is routed along each perforating gun body 316*a*, 316*b* to a signal input on each detonator 360. The signal conductors 570 are interconnected via the connection between each pair of adjacent perforating guns to form a continuous signal path for communicating electrical signals from the wireline 507, along the perforating gun assembly 102, and to each detonator 360. The location of the detonator 360, and the routing of the detonating cord 540 and signal conductors 570 within each perforating gun body 316*a*, 316*b*, are illustrated by way of example and may vary according to the design of the perforating gun selected.

One or more aspects of the present disclosure may be used in various commercial gun systems to increase service quality and reliability of such systems and related products. These features may also be compatible with various third party equipment, may increase the likelihood for a reliable electrical connection downhole, maintain good service quality, and serve to maintain the reputation of established products while reducing non-productive time (NPT) at the work site. Also, as this design may in some examples not rely on additional fasteners, there may also be a potential cost reduction due to the removal of additional external fasteners which would ordinarily be required when designing a perforating gun.

Accordingly, the present disclosure may provide a perforating gun and related apparatus, systems, and methods, which may have improved ergonomics of assembly, material reduction, improved downhole reliability, and decreased risk of detonation failure. The methods, systems, and tools may include any of the various features disclosed herein, including one or more of the following statements.

Statement 1: A detonator assembly comprising: a detonator housing comprising a detonating cord receptacle and a detonator receptacle, a detonator seated within the detonator receptacle; a detonating cord side-by-side the detonator and seated within the detonating cord receptacle; and a grounding clip that extends lengthwise along a substantial portion of the detonator housing, wherein the grounding clip extends beyond an axial end of the detonator housing.

Statement 2: The detonator assembly of statement 1, wherein the grounding clip comprises two flexible locking tabs extending out from either side of an elongated body portion of the grounding clip.

Statement 3: The detonator assembly of statements 1 or 2, wherein an upper end of the grounding clip wraps around a radial protrusion of the detonator housing.

Statement 4: The detonator assembly of any of statements 1-3, wherein the detonator housing comprises a raised box with a pin hole for receiving an electrical pin.

Statement 5: The detonator assembly of any of statements 1-4, wherein the detonator housing comprises a plurality of non-contiguous peripheral portions circumferentially spaced around a central axis of the detonator housing.

Statement 6: The detonator assembly of any of statements 1-5, wherein the detonator housing comprises a click-lock fastener unitarily formed as part of the detonator housing.

Statement 7: The detonator assembly of any of statements 1-6, wherein the detonator housing comprises a collet and a lug configured to seat within openings of a charge tube.

Statement 8: The detonator assembly of any of statements 1-7, wherein the detonator housing comprises plastic.

Statement 9: The detonator assembly of any of statements 1-8, wherein the detonator housing comprises a skeletonized body to reduce an amount of material occupied by the detonator assembly.

Statement 10: The detonator assembly of any of statements 1-9, wherein the grounding clip comprises a single piece of conductive metal.

Statement 11: The detonator assembly of any of statements 1-10, wherein the detonator receptacle and the detonating cord receptacle each comprise one or more stops to prevent over-insertion of either or both the detonating cord and the detonator.

Statement 12: A perforating gun comprising: a tubular member; and a detonator assembly disposed within the tubular body, wherein the detonator assembly comprises: a detonator housing comprising a detonating cord receptacle and a detonator receptacle, a detonator seated within the detonator receptacle; a detonating cord side-by-side the detonator and seated within the detonating cord receptacle; and a grounding clip that extends lengthwise along a substantial portion of the detonator housing, wherein the grounding clip extends beyond an axial end of the detonator housing.

Statement 13: The perforating gun of statement 12, wherein the grounding clip comprises inward bends biased at an angle to resist compression when a charge tube is housed by the gun body.

Statement 14: The perforating gun of statements 13, wherein the detonator housing comprises one or more mating notches configured to mate with corresponding slots of the tubular member to prevent circumferential drift of the detonator assembly within the tubular member.

Statement 15: The perforating gun of any of statements 12-14, wherein the grounding clip comprises two or more inward bends, wherein an upper end of the grounding clip is biased away from the detonator housing to axially contact the tubular member.

Statement 16: The perforating gun of statement 15, further comprising: a first configuration, wherein the upper end of the grounding clip is biased at an angle greater than 30 degrees relative to a central axis of the perforating gun; and a second configuration, wherein the upper end of the grounding clip is biased at an angle less than 30 degrees relative to a central axis of the perforating gun.

Statement 17: A method comprising: providing at least a tubular member for a perforating gun string; disposing a detonator housing within the tubular member; disposing a detonator within a detonator receptacle of the detonator housing; disposing a detonating cord within a detonating cord receptacle of the detonator housing and side-by-side to the detonator; and disposing a grounding clip within at least a portion of the detonator housing, wherein an upper end of the detonator housing makes an interference contact with a conductive surface of the tubular member.

Statement 18: The method of statement 17, wherein a tapered end of the grounding clip makes an interference contact with a machined metal surface of a bulkhead connecting the tubular member to an additional tubular member of the perforating gun string.

Statement 19: The method of statement 18, further comprising compressing two or more flexible locking tabs towards a central axis of the grounding clip to engage a shoulder, thereby causing the grounding clip to become fixedly retained within a slot of the detonator housing.

Statement 20: The method of statement 19, further comprising compressing the upper end and the tapered end to exert a spring-like force on the tubular member and the bulkhead.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A detonator assembly comprising:

a detonator housing comprising a detonating cord receptacle and a detonator receptacle, a detonator seated within the detonator receptacle;

a detonating cord side-by-side the detonator and seated within the detonating cord receptacle; and a grounding clip that extends lengthwise along a substantial portion of the detonator housing, wherein the grounding clip comprises a single piece of conductive metal having an elongated body portion with two consecutive inward bends on an upper end that lead to a ninety-degree bend towards an axial end of the detonator housing.

2. The detonator assembly of claim 1, wherein the grounding clip comprises two flexible locking tabs extending out from either side of an elongated body portion of the grounding clip.

3. The detonator assembly of claim 1, wherein an upper end of the grounding clip wraps around a radial protrusion of the detonator housing.

4. The detonator assembly of claim 1, wherein the detonator housing comprises a raised box with a pin hole for receiving an electrical pin.

5. The detonator assembly of claim 1, wherein the detonator housing comprises a plurality of non-contiguous peripheral portions circumferentially spaced around a central axis of the detonator housing.

6. The detonator assembly of claim 1, wherein the detonator housing comprises a click-lock fastener unitarily formed as part of the detonator housing.

7. The detonator assembly of claim 1, wherein the detonator housing comprises a collet and a lug configured to seat within openings of a charge tube.

8. The detonator assembly of claim 1, wherein the detonator housing comprises plastic.

9. The detonator assembly of claim 1, wherein the detonator housing comprises a skeletonized body to reduce an amount of material occupied by the detonator assembly.

10. The detonator assembly of claim 1, wherein the detonator receptacle and the detonating cord receptacle each comprise one or more stops to prevent over-insertion of either or both the detonating cord and the detonator.

* * * * *